US006491380B2

(12) United States Patent
Taneya et al.

(10) Patent No.: US 6,491,380 B2
(45) **Date of Patent: *Dec. 10, 2002**

(54) LIQUID DISCHARGING HEAD WITH COMMON INK CHAMBER POSITIONED OVER A MOVABLE MEMBER

(75) Inventors: Yoichi Taneya, Yokohama (JP); Masahiko Ogawa, Hino (JP); Masami Ikeda, Tokyo (JP); Ichiro Saito, Yokohama (JP); Hiroyuki Ishinaga, Tokyo (JP); Toshio Kashino, Chigasaki (JP); Tomoyuki Hiroki, Zama (JP); Yoshiyuki Imanaka, Kawasaki (JP); Teruo Ozaki, Yokohama (JP); Masahiko Kubota, Tokyo (JP); Aya Yoshihira, Yokohama (JP); Kiyomitsu Kudo, Kawasaki (JP); Hiroyuki Sugiyama, Sagamihara (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/204,264

(22) Filed: Dec. 3, 1998

(65) Prior Publication Data

US 2002/0015078 A1 Feb. 7, 2002

(30) Foreign Application Priority Data

Dec. 5, 1997 (JP) ..... 9-336055
Dec. 5, 1997 (JP) ..... 9-336108
Dec. 5, 1997 (JP) ..... 9-336109

(51) Int. Cl.[7] ..... B41J 2/05
(52) U.S. Cl. ..... 347/65
(58) Field of Search ..... 347/63, 65, 67, 347/20, 54, 56

(56) References Cited

U.S. PATENT DOCUMENTS

| | | | | |
|---|---|---|---|---|
| 4,450,455 A | | 5/1984 | Sugitani et al. | 347/47 |
| 4,480,259 A | | 10/1984 | Kruger et al. | 347/65 |
| 4,558,333 A | | 12/1985 | Sugitani et al. | 347/65 |
| 4,611,219 A | | 9/1986 | Sugitani et al. | 347/63 |
| 4,646,110 A | | 2/1987 | Ikeda et al. | 347/48 |
| 4,723,129 A | | 2/1988 | Endo et al. | 347/56 |
| 4,994,825 A | | 2/1991 | Saito et al. | 347/63 |
| 5,208,604 A | | 5/1993 | Watanabe et al. | 347/47 |
| 5,278,585 A | * | 1/1994 | Karz et al. | 347/65 |
| 5,389,957 A | | 2/1995 | Kimura et al. | 347/20 |
| 5,657,539 A | | 8/1997 | Orikasa et al. | 29/890.1 |
| 5,821,962 A | * | 10/1998 | Kudo et al. | 347/65 |
| 5,943,074 A | | 8/1999 | Kashino et al. | 347/54 |

FOREIGN PATENT DOCUMENTS

| | | | |
|---|---|---|---|
| EP | 0176596 | 4/1986 | B41J/3/04 |
| EP | 0436047 | 7/1991 | B41J/2/055 |
| EP | 0745479 | 12/1996 | B41J/2/14 |
| JP | 55-81172 | 6/1980 | |
| JP | 61-19372 | 1/1986 | |
| JP | 61-69467 | 4/1986 | |
| JP | 63-199972 | 8/1988 | |
| JP | 1-90754 | 4/1989 | |
| JP | 5-124189 | 5/1993 | |

* cited by examiner

*Primary Examiner*—Raquel Yvette Gordon
*Assistant Examiner*—Juanita Stephens
(74) *Attorney, Agent, or Firm*—Fitzpatrick, Cella, Harper & Scinto

(57) ABSTRACT

A liquid discharging head comprises a discharging port for discharging liquid, a liquid flow path communicated with said discharging port, a bubble generating region for causing the liquid to generate a bubble and a movable member having provided thereon a free end disposed facing to said bubble generating region, and on the downstream of said liquid flow path directed toward said discharging port. At least when said movable member is in stationary state, a side of said liquid flow path corresponding to said bubble generating region is substantially composed of all with a wall face and common communicating space for commonly communicating said liquid flow path with a neighboring liquid flow path is provided in the upward of a movable section of said movable member.

21 Claims, 23 Drawing Sheets

FIG. 10A1
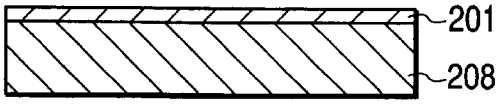
FIG. 10A2
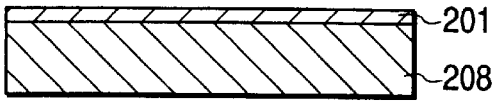
FIG. 10B1
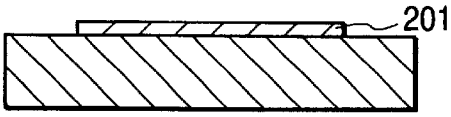
FIG. 10B2
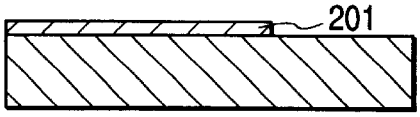
FIG. 10C1
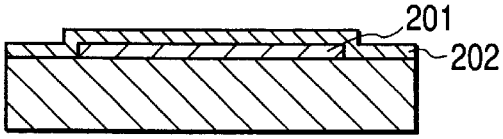
FIG. 10C2
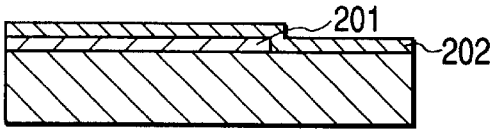
FIG. 10D1
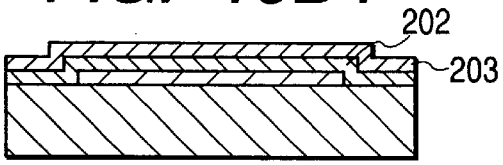
FIG. 10D2
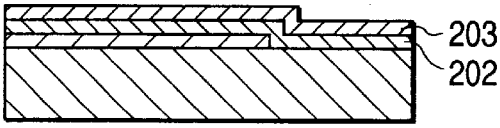
FIG. 10E1
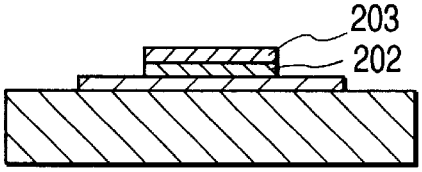
FIG. 10E2
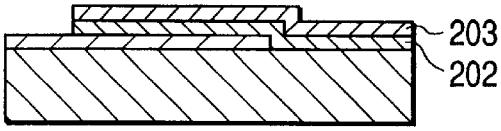
FIG. 10F1
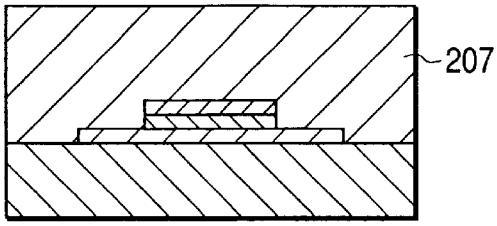
FIG. 10F2
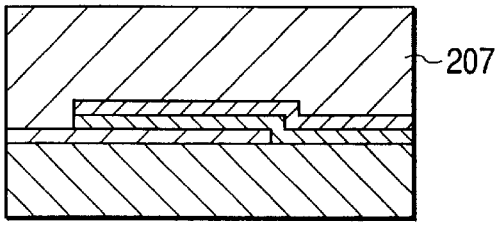

FIG. 11G1
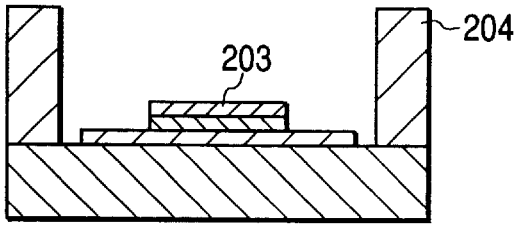
FIG. 11G2
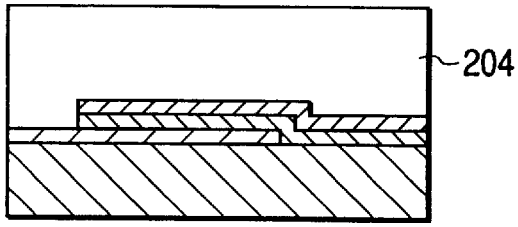
FIG. 11H1
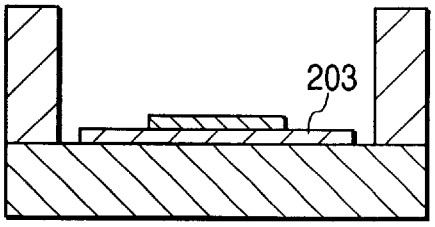
FIG. 11H2
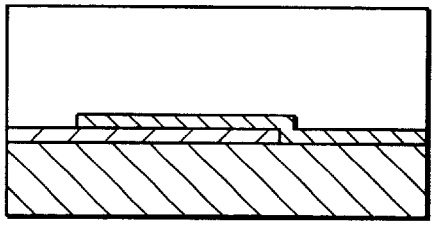
FIG. 11I1
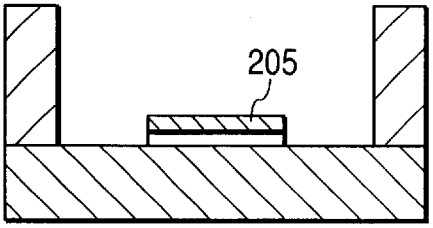
FIG. 11I2
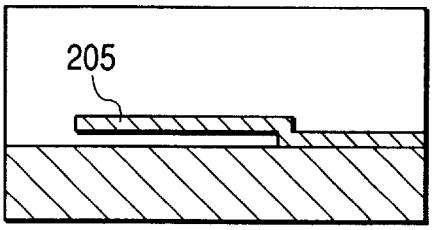

FIG. 12G1
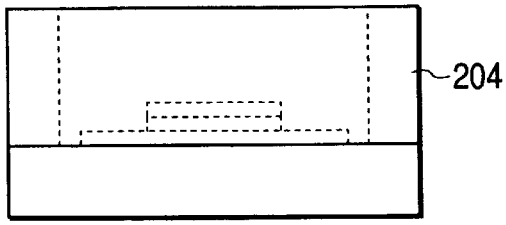
FIG. 12G2
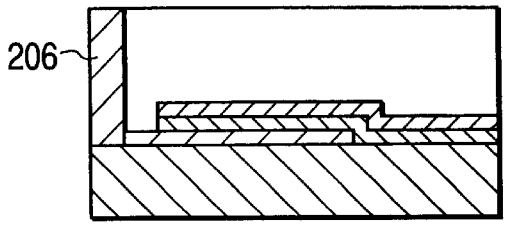
FIG. 12H1
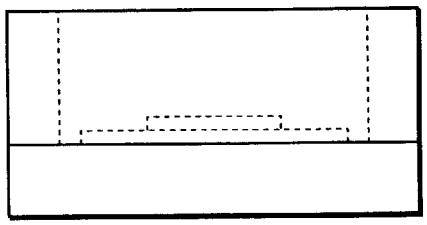
FIG. 12H2
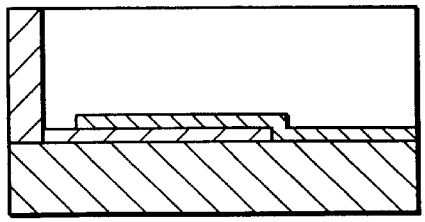
FIG. 12I1
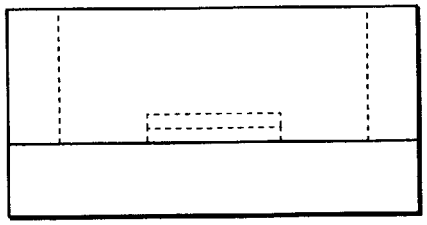
FIG. 12I2
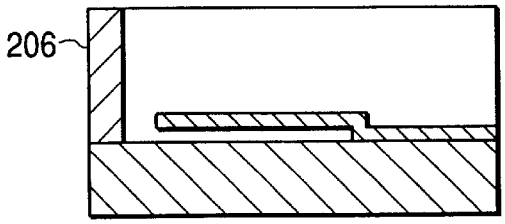
FIG. 12J1
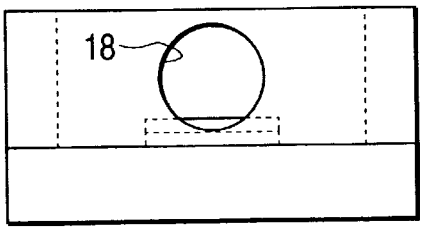
FIG. 12J2
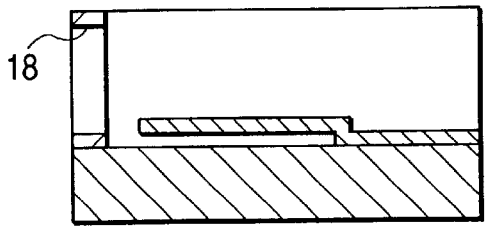

LIQUID DISCHARGING HEAD WITH COMMON INK CHAMBER POSITIONED OVER A MOVABLE MEMBER

BACKGROUND OF THE INVENTION

1. Field of the Invention

The present invention relates to a liquid discharging head for discharging liquid by generating bubbles by virtue of thermal energy being acted on the liquid and a liquid discharging apparatus using the liquid head. The present invention also relates to a novel liquid discharging method associated with displacement of a removable member and bubble growth, and a liquid discharging head and a liquid discharging apparatus for performing thereof.

The present invention is applicable to such apparatus as a printer, a copier, a facsimile having a communication system, a word processor having a printer, or the like for recording on a recording medium such as paper, yarn, fiber, woven fabric, leather, metal, plastic, glass, wood, ceramic, or the like, and further to an industrial recording apparatus compositely combined with various kinds of processing apparatuses. In this invention, "recording" means not only providing a meaningful image of a character or a picture onto a recording medium but also providing a meaningless image such as a pattern or the like.

2. Related Background Art

Conventionally, an ink jet recording method for producing an image first by providing energy such as heat or the like to ink to cause a state change associated with abrupt volume change and generation of bubbles, and then discharging the ink from a discharging port by means of active force originated from the state change to adhere the ink onto the recording medium, or so-called a bubble jet recording method. To the bubble jet recording method, a discharging port for discharging ink, an ink flow path communicating with the discharging port, and an electrothermal converting element as a means for generating energy for discharging ink disposed in the ink flow path are provided, as disclosed in official gazettes such as the specification of U.S. Pat. No. 4,723,129 and the like.

According to such recording method, as a high quality image can be recorded in high speed and with reduced noise, and a discharging port for discharging ink can be arranged in high density on a recording head by the method, the method has a plenty of advantages such that a high resolution recorded image can be produced by a compact apparatus, and even a color image can be obtained with ease. Therefore, in recent years, the bubble jet recording method has been used in a multiplicity of office apparatuses such as printers, copiers, facsimiles and the like, and further even in industrial systems such as textile printing apparatuses and the like.

With the spread use of the bubble jet technique in a variety of products, a variety of demand such as follows has further been increasingly made in recent years. As an example, optimization of a heating element such as adjustment of the thickness of a protective film is consideration to the demand for improvement in energy efficiency. This method has an advantage to improve conductive efficiency of generated heat into liquid. Further, in order to obtain a high quality image, a driving condition for providing a liquid discharging method and the like in which ink discharging speed is fast, and which can discharge ink attributable to stabilized bubble generation in a good condition have been proposed, and in order to obtain a liquid discharging head which is fast in speed in refilling discharged liquid into a liquid flow path, from a stand point of high speed record, an apparatus having improved liquid flow path shape has been proposed.

Among the flow path shape, the flow path construction and the head manufacturing method described in Japanese Patent Application Laid-Open No. 63-199972 and the like are inventions taking notice of a back wave (pressure toward the direction reverse to the direction toward the discharging port, or pressure toward a liquid chamber) which is generated in association with the generation of bubbles. The back wave is known as energy loss, as the energy is not directed to the discharging direction. A head disclosed in Japanese Patent Application Laid-Open No. 63-199972 has a valve located apart from a bubbling region of bubbles produced by a heating element and opposite to a discharging port relative to the heating element. The valve has an initial position as if stuck to a ceiling of the flow path because of the manufacturing method by use of plate material or the like, and hangs down into the flow path in association with generation of the bubbles. The invention discloses that energy loss can be controlled when a part of the above described back wave is controlled by the valve.

However, in the construction, as can be seen if behavior in the flow path before and after generation of bubbles in the flow path which retains liquid to be discharged, partial inhibition of the back wave by a valve can be understood not necessarily practical for liquid discharging. Originally, the back wave itself is not directly related with the liquid discharging. Therefore, even if a part of the back wave is inhibited, the liquid discharging cannot be greatly influenced.

Further, in order to improve ink refilling and obtain a head which is excelled in frequency responsibility, a head of a structure in which heater neighborhood of a nozzle is communicated with a subordinate flow path has conventionally been proposed. When refilling ink, ink is refilled as well from the subordinate flow path into the nozzle to reduce refilling time. However, the head of the structure has a fear that reduction in discharging efficiency may be caused, as a part of the discharging force generated at the time of bubbling escapes to the subordinate flow path.

SUMMARY OF THE INVENTION

A major object of the present invention is to improve fundamental discharging characteristic in a method for producing bubbles (more particularly, bubbles associated with film boiling) in a liquid flow path to discharge liquid, to such a level unthinkable and unpredictable from the conventional standpoint.

Some of the inventors of the present invention previously came back to principles of liquid droplet discharging, and devotedly studied to provide a novel liquid droplet discharging method using bubbles which had conventionally been unobtainable, and a head and the like to be used therefor. More particularly, a first technical analysis which is originated from operation of a movable member in a liquid flow path such as analysis of the principle of structure of a movable member in a flow path, and a second technical analysis which is originated from the principle related to liquid droplet discharging by bubbles, and further a third technical analysis which is originated from bubble producing region of a heating member for producing bubbles have been performed.

As a result of these analyses, a completely novel technique for positively controlling the bubbles has come to be established by disposing the movable member facing to the heating member or the bubble generating region. Another feature of the present invention is, based on knowledge that use of downstream growth component of a bubble is the greatest contributing factor in significantly improving the discharging characteristic, if energy given to the discharging volume by the bubbles per se is considered, to efficiently convert the downstream growth component of the bubbles toward the discharging direction. By the conversion, improvement in the discharging efficiency and the discharging speed can be realized.

The present invention is to provide a novel discharging method and a novel discharging principle which further improve the above described epoch-making discharging principle. In other words, the present invention seeks after a discharging principle which enables further improvement in the discharging efficiency and refilling properties, by considering relation between the displacement of a free end of the movable member and the growth of bubbles obtained from the bubble generating region, and further, arrangement of the movable member and a structural element of the liquid flow path.

One of the objects of the present invention is to provide a liquid discharging head, a liquid discharging apparatus, and a liquid discharging method with improved discharging efficiency and liquid refilling properties, by considering arrangement of the movable members and a structural element of the liquid flow path.

Another object of the present invention is to provide a liquid discharging head, a liquid discharging apparatus, and a liquid discharging method with improved refilling frequency and printing speed, by inhibiting the inertia to work in a direction reverse to the liquid feeding direction due to the back wave by the valve mechanism of the movable member, and by reducing retreat volume of meniscus.

A further object of the present invention is to provide a liquid discharging head, a liquid discharging apparatus, and a liquid discharging method with improved discharging efficiency by making the removable member quickly arrive at a proper displacement position, by reducing resistance from the liquid flow path to the predetermined displacement position of the movable member, when the valve mechanism of the movable member is activated by generation of the bubbles.

A further object of the present invention is to provide a liquid discharging head, a liquid discharging apparatus, and a liquid discharging method which are capable of liquid discharging in good condition by greatly reducing heat accumulation in the liquid on the heating member and by reducing residual bubbles on the heating member.

A further object of the present invention is to provide a liquid discharging head, a liquid discharging apparatus, and a liquid discharging method which are capable of solving mechanical characteristic problems associated with difference of the materials of each composing part of the liquid discharging head.

A further object of the present invention is to provide a liquid discharging head, a liquid discharging apparatus, and a liquid discharging method which are capable of making the liquid discharging head compact by solving problems associated with assembling of each composing parts of the liquid discharging head, and by achieving a high density arrangement of the heating member on an element substrate.

A further object of the present invention is to provide a liquid discharging head comprising a discharging port for discharging liquid, a liquid flow path communicated with the discharging port, a bubble generating region for causing the liquid to generate a bubble, and a movable member having provided thereon a free end disposed facing to the bubble generating region, and on the downstream of the liquid flow path directed toward the discharging port, wherein at least when the moving member is in stationary state, a side of the liquid flow path corresponding to the bubble generating region is substantially composed of all with a wall face said wall face existing at a side of said free end of said movable member when said movable member is at a maximum displacement state, and common communicating space commonly communicating the liquid flow path with a neighboring liquid flow path is provided in the upward of a movable section of the movable member.

A still further object of the present invention is to provide a liquid discharging method using a liquid discharging head, having a discharging port for discharging liquid, a liquid flow path communicated with the discharging port, a bubble generating region for causing liquid to generate a bubble, and a movable member disposed facing to the bubble generating region and having provided thereon a free end on the downstream of the liquid flow path directed toward the discharging port; comprising a liquid discharging process for discharging liquid by a side of the liquid flow path, corresponding to the bubble generating region which is at least substantially composed of all with a wall face, a side portion of said free end of said movable member when said movable member is at a maximum displacement state and the movable member, such that growth of a bubble in the bubble generating region is inhibited to be directed toward the discharging port, and a liquid feeding process for feeding liquid, after bubble shrinkage being started, from common communicating space which commonly communicates the liquid flow path with a liquid flow path neighboring to the liquid flow path, arranged in the upward of a movable section of the movable member, toward the discharging port.

According to the present invention, by effectively leading expansion of the downstream portion of a bubble, generated in the bubble generating region, and travel of the liquid associated therewith toward the direction of the discharging port, discharging efficiency can be improved. Further, expansion of the upstream portion of a bubble and travel of the liquid associated therewith toward the upstream can be prevented or inhibited by the movable member, a side wall along displacement of the movable member, and an upper wall in the direction of displacement. Further, when the bubble shrinks and the liquid is refilled in the direction of discharging, high speed refilling is made possible from a low flow resistance region, which is lacking an upper wall, adjacent to a side wall, associated with return of the movable member. Further, by the side wall, side escape of the bubble and discharging pressure to the neighboring liquid flow path can be prevented, enabling efficient discharging of the liquid in the vicinity of the discharging port, thus the discharging efficiency can be improved.

In this way, stabilized growth of the bubble and stabilized production of the liquid droplet can be achieved, enabling high speed and high quality recording in high responsibility by a high speed liquid droplet. Further, synergistic effect between the growing bubble and the movable member which is displaced thereby can be obtained, enabling the liquid in the vicinity of the discharging port to be efficiently discharged, thus the discharging efficiency can be improved.

Further, according to the present invention, when a movable member travels to a predetermined displacement position by growth of the bubble, resistance which the movable member receives from a liquid flow path is reduced to enable the movable member quickly arrive at a proper displacement position, thus the discharging efficiency can be improved.

According to the present invention, by having a fulcrum of a movable member existed in a common liquid chamber, refilling properties of liquid can be improved.

According to the present invention, even when a liquid discharging apparatus is left standing at the low temperature or in the low humidity, the liquid discharging apparatus is prevented from becoming discharging-unable, and even if the liquid discharging apparatus becomes discharging-unable, the liquid discharging apparatus has an advantage of being recovered to the normal state on the spot by a simple recovery process such as preliminary discharging or absorption recovery. By the recovery process, time required for recovery can be reduced, and liquid loss can be reduced, thus running cost can significantly be reduced.

In the present invention, if silicon based material is used as material for each composing part, ink resistance can be improved, and problems of mechanical characteristic associated with difference in linear expansion coefficient of each composing part can be solved.

In the present invention, if each composing element is incorporated in a film forming process, problems of mechanical characteristic and problems associated with assembly can be solved, and further achieving high density arrangement of heating member on the element substrate, enabling compactization of a liquid discharging head.

Meantime, "upstream" and "downstream" used in the description of the present invention represent expressions regarding flow direction of liquid from feeding source of the liquid toward the discharging port via the bubble generating region (or a movable member). Further, "downstream side" regarding the bubble itself mainly represents a portion of the bubbles on the side of the discharging port which is said to directly act on discharging of liquid droplet. More particularly, the bubble generated in the downstream relative to the above stated flow direction with respect to the center of the bubble, or in the downstream region from the center of the area of the heating members is meant.

Further, "substantially closed" used in the description of the present invention means, when a bubble grows, the bubble is in a state such that the bubble is unable to pass through a slit around the movable member prior to the displacement of the movable member.

Further, "separation wall" used in the description of the present invention means, in a broad sense, a wall (a movable member may be included) which intervenes such that the bubble generating region is separated from a region directly communicated with the discharging port, and in a narrow sense, a matter which separates a flow path including the bubble generating region from a liquid flow path directly communicated with the discharging port to prevent mixing of liquids being in respective regions.

Further, "bubble generating region" used in the description of the present invention represents a region where a bubble, generated between a substrate having means for causing the liquid to generate a bubble and a movable member can exist, and when a bubble generating means is a heating member, the region occupies a range slightly larger than the area of the heating member under the normal driving condition applicable to the products. Besides, displacement of the movable member associated with expansion of the bubble enlarges the bubble generating region, and the region where the bubble has existed can finally be defined as the bubble generating region.

The other objects of the present invention will be understood from the following description.

BRIEF DESCRIPTION OF THE DRAWINGS

FIGS. 10A1, 10A2, 10B1, 10B2, 10C1, 10C2, 10D1, 10D2, 10E1, 10E2, 10F1 and 10F2 show schematic process flow diagrams of an example of a manufacturing method for a liquid discharging head of the present invention;

FIGS. 11G1, 11G2, 11H1, 11H2, 11I1 and 11I2 show schematic process flow diagrams of an example of a manufacturing method for a liquid discharging head of the present invention;

FIGS. 12G1, 12G2, 12H1, 12H2, 12I1, 12I2, 12J1 and 12J2 show schematic process flow diagrams of another example of a manufacturing method for a liquid discharging head of the present invention;

DETAILED DESCRIPTION OF THE PREFERRED EMBODIMENTS

Figure 1A:
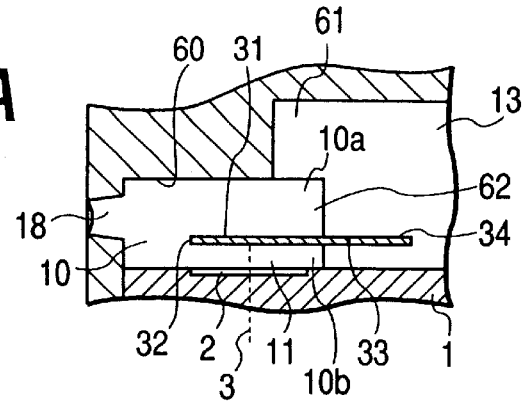
FIGS. 1A, 1B, 1C, 1D and 1E show schematic side sectional views of an example (first embodiment) of a liquid discharging head of the present invention and similar views showing driving aspects of the discharging head.

Embodiments of the present invention will be described with reference to the drawings.

Description of Principles

Discharging principles applicable to the present invention will be described hereunder in detail. FIGS. 1A to 1E are sectional schematic views of a liquid discharging head cut in the direction of the liquid flow, and FIG. 2 is a sectional cut perspective view of the liquid discharging head.

The liquid discharging head illustrated in FIGS. 1A to 1E are provided with a heat generating member 2 (in this example, a rectangular heat generating resistor of 40 $\mu$m×105 $\mu$m) on an element substrate 1 for generating thermal energy which is an energy generating element to generate energy to be used for discharging liquid, and on the element substrate a liquid flow path 10 is disposed corresponding to the heat generating member 2. The liquid flow path 10 is communicated with a discharging port 18 as well as a common liquid chamber 13 which is for feeding liquid to a plurality of liquid flow path 10, and receives liquid from the common liquid chamber 13 in quantity equivalent to the quantity of liquid discharged from the discharging port.

On the element substrate of the liquid flow path 10, opposingly faced with the heat generating member 2, a plate-shaped movable member 31, having a plane section, and composed of material having elasticity such as metal, is provided like a cantilever. One end of the movable member is secured to a base (support member) 34 or the like formed with photosensitive resin or the like subjected to patterning on a wall of the liquid flow path 10 or the element substrate. Thus, the base holds the movable member and constitutes a fulcrum (fulcrum section) 33.

The movable member 31 has the fulcrum (fulcrum section; fixed end) 33 on the upstream of a large flow, flowing to the side of a discharging port 18 from the common liquid chamber 13 via the movable member 31, and is arranged apart from the heat generating member with distance of 15 $\mu$m in a state likely to cover the heat generating member 2 at a position facing to the heat generating member 2 for having a free end (free end section) 32 on the downstream relative to the fulcrum 33. The region between the heat generating member and the movable member becomes a bubble generating region. Meanwhile, the kind and shape of a heat generating member and a movable member are not restricted thereto, and a heat generating member and a movable member in such a shape and in an arrangement that may control bubble growth and pressure propagation may satisfactorily work to be described later. Meantime, for description of a liquid flow to be taken up later, the liquid flow path 10 described above will further be described, divided by the movable member 31 into two regions comprising a first liquid path 10*a* covering a section directly communicated with the discharging port 18 and a second liquid flow path 10*b* having a bubble generating region 11.

By generating heat at the heat generating member 2, the heat is applied to liquid in the bubble generating region 11 between the movable member 31 and the heat generating member 2, and a bubble based on the film boiling phenomenon as disclosed in U.S. Pat. No. 4,723,129 is generated. Pressure and a bubble based on the generation of the bubbles preferentially act on the movable member, and the movable member 31 displaces, as illustrated in FIGS. 1B, 1C or FIG. 2, in such a way to widely open toward the discharging port centering on the fulcrum 33. By the displacement or the displaced state of the movable member 31, propagation of the pressure based on the generation of the bubbles or growth of the bubble per se is led toward the discharging port.

One of the basic discharging principles to be applied to the present invention will be described here. One of the most important principles in this invention is that a movable member disposed opposingly to the bubble displaces from a first position or stationary state to a second position or a displaced position based on the pressure of the bubble or the bubble per se, and the displacing movable member 31 leads the pressure originated by the generation of the bubble or the bubble per se toward the downstream where the discharging port 18 is disposed.

Figure 3:
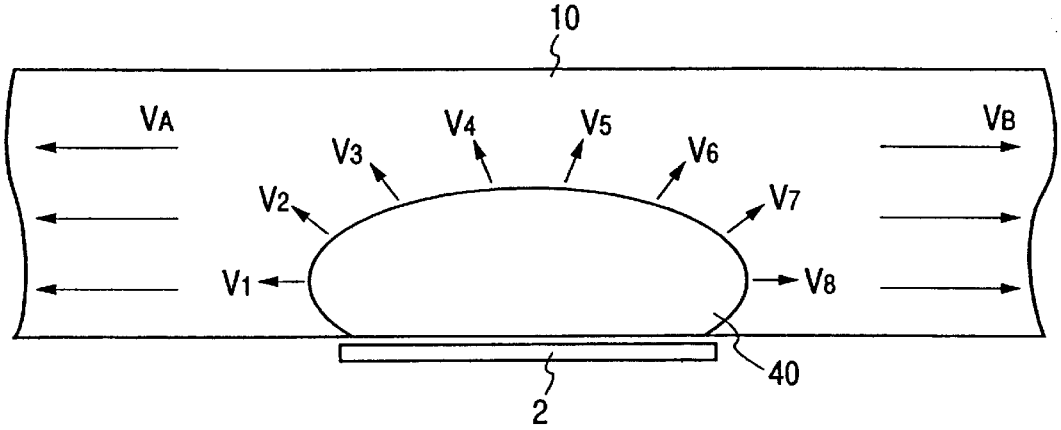
FIG. 3 PRIOR ART
FIG. 3 is a schematic diagram showing pressure propagation from a bubble in a conventional liquid discharging head.
Figure 4:
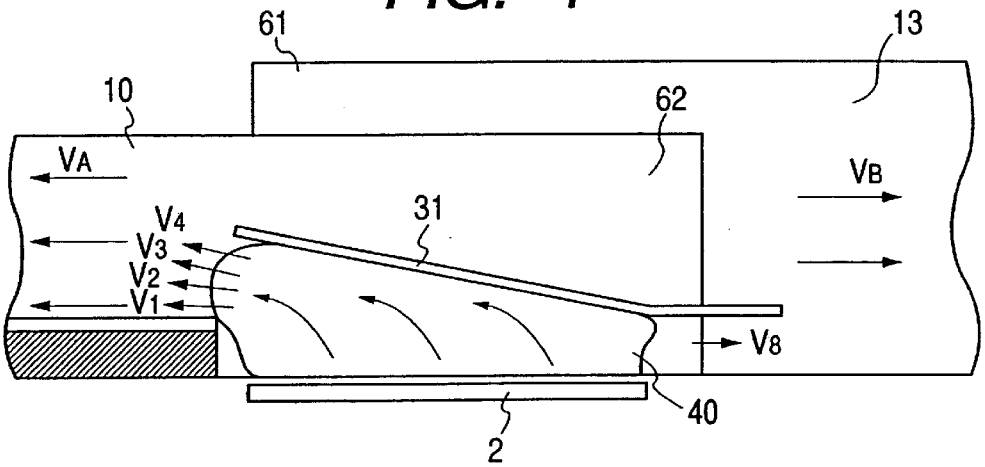
FIG. 4 is a schematic side sectional view showing pressure propagation from a bubble in a liquid discharging head of the present invention.

The principle will further be described more in detail comparing FIG. 3 schematically showing conventional liquid flow path without a movable member and FIG. 4 illustrating the present invention. In FIGS. 3 and 4, the direction of the pressure propagation toward the discharging port is indicated by $V_A$, and the direction of the pressure propagation toward the upstream is indicated by $V_B$.

The conventional heads as illustrated in FIG. 3 has no mechanism to regulate the propagation direction of the pressure by generated bubble 40. Accordingly, the pressure propagation directions of the bubble 40 are perpendicular to the surface of the bubble as indicated by $V_1$ to $V_8$, and is directed to various directions. Of the directions, directions having components of the pressure propagation direction in $V_A$ direction, which particularly gives the greatest influence on the liquid discharging, are the directions having direction components of $V_1$ to $V_4$ or a portion nearer to the discharging port than the half way position of the bubble, and the portion is important in directly contributing to liquid discharging efficiency, liquid discharging force, discharging speed, and the like. Further, $V_1$ being located nearest to the $V_A$ direction works efficiently, while $V_4$ to the contrary has comparatively small direction component toward $V_A$.

In the case of the present invention as illustrated in FIG. 4, however, the movable member 31 leads the pressure propagation directions $V_1$ to $V_4$ of the bubble, which have been variously directed as in FIG. 3, toward the downstream (toward the discharging port), and convert the component of the pressure propagation direction into the pressure propagation direction of $V_A$, thus the pressure from the bubble 40 directly contributes to efficient discharging. In addition, growth direction per se of the bubble is led toward the downstream similarly with the pressure propagation directions $V_1$ to $V_4$, and the bubble grows larger in the downstream than in the upstream. In this way, growth direction per se of a bubble is controlled by a movable member, and pressure propagation direction of the bubble is controlled, and resultantly traveling direction of liquid is controlled to be efficiently directed toward the discharging port, thus fundamental improvement in discharging efficiency, discharging force, discharging speed and the like can be achieved.

Now, reverting to FIGS. 1A to 1E, discharging operation of the liquid discharging head described above will be described in detail.

Figure 1B:
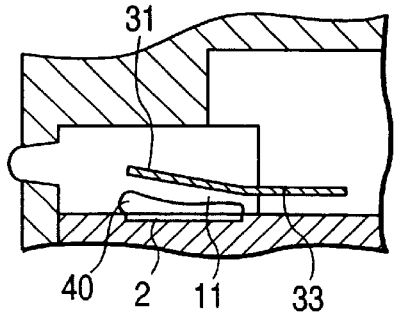
Figure 1C:
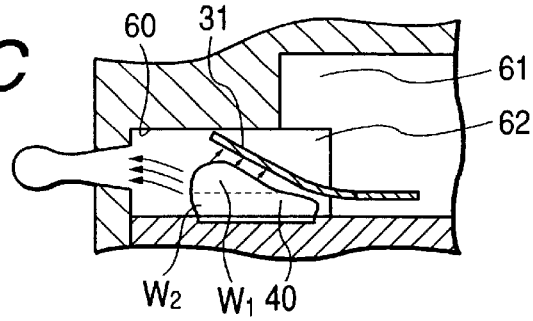
Figure 2:
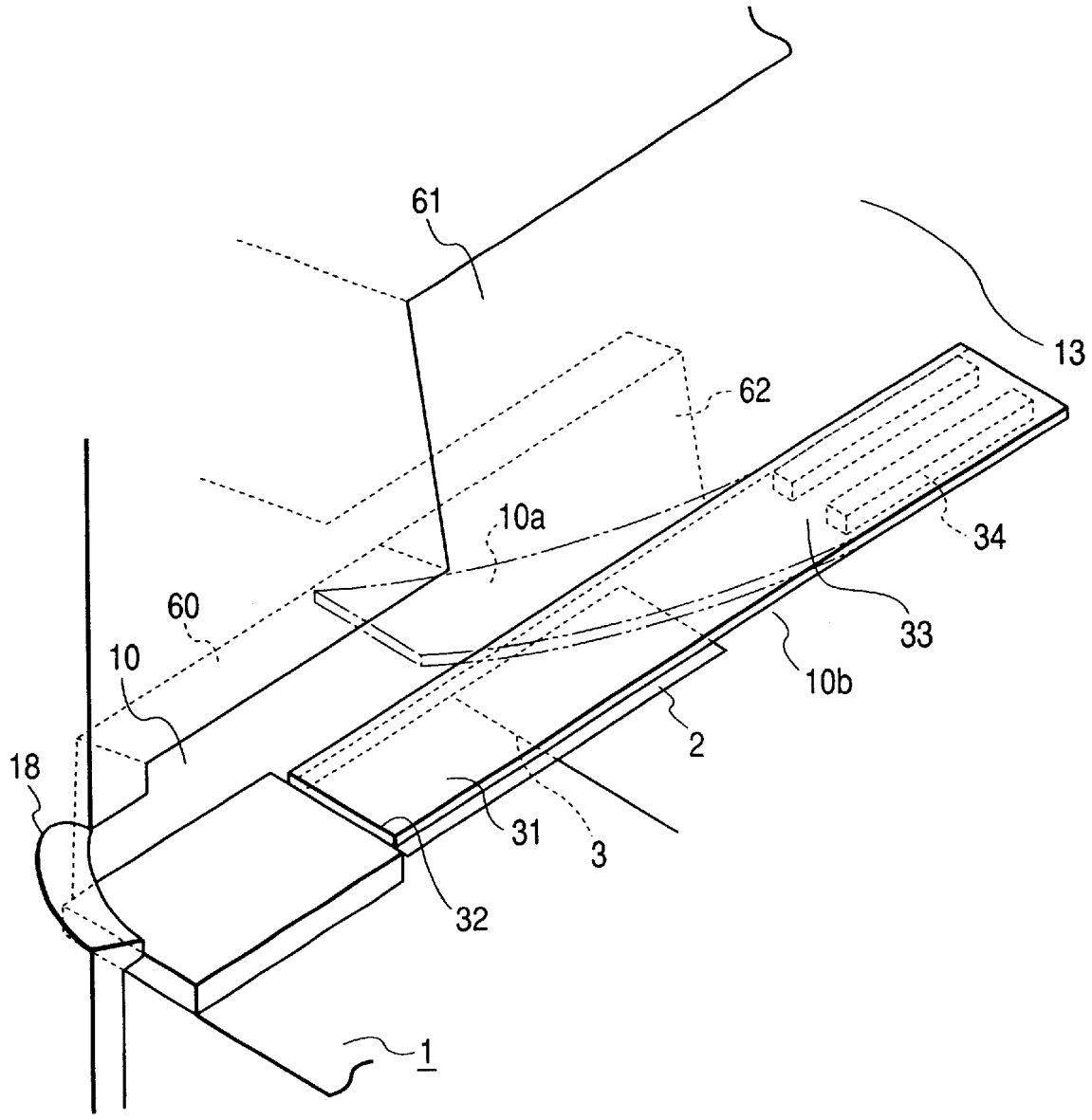
FIG. 2 is a schematic partial cut perspective view showing a liquid discharging head of the present invention.

In FIG. 1A, a heat generating member 2 is in a state prior to application of energy such as electric energy or the like, namely the heat generating member is in a state prior to generating heat. What is important here is that the movable member 31 is, relative to a bubble generated by heat which is generated by the heat generating member, provided at a position at least facing to the downstream of the bubble. In other words, the movable member 31 is provided in the liquid flow path structure at least to a position downstream of the area center 3 of the heat generating member (downstream of a line which passes through the area center 3 of the heat generating member and orthogonally crosses lengthwise direction of the flow path).

FIG. 1B shows a state where electric energy or the like is applied to the heat generating member 2, heat is generated by the heat generating member 2, and the heat thus generated heats a part of liquid filled the bubble generating region 11, and a bubble is generated in association with film boiling. At this time, the removable member 31 displaces from a first position to a second position in such a way to lead the pressure propagation direction of the bubble 40 toward the discharging port by means of pressure based on the generation of the bubble 40. What is important here is, as described before, that a free end 32 of the movable member 31 is arranged on the downstream (the side of the discharging port), a fulcrum 33 is arranged so as to be positioned on the upstream (on the side of the common liquid chamber), and at least a part of the movable member is faced to the downstream section of the heat generating member or the downstream section of the bubble.

FIG. 1C shows a state where the bubble 40 has further grown, but the movable member 31 is further displaced corresponding to the pressure associated with the generation of the bubble 40. When leading the bubble or the bubble generating pressure toward the discharging port, the movable member causes little hindrance to the transfer, and the pressure propagation direction and the bubble growth direction can be efficiently controlled depending on the magnitude of the propagating pressure. At this occasion, the upstream side of the movable member is displaced to a predetermined position with limited displacement resistance an upper wall lacking region 61 to promptly achieve the above described advantage, and thereafter, travel of the liquid to the upstream is prevented by collaboration between an upper wall 60 and a side wall 62 of the liquid flow path 10 to improve efficiency at the time of refilling.

Figure 1D:
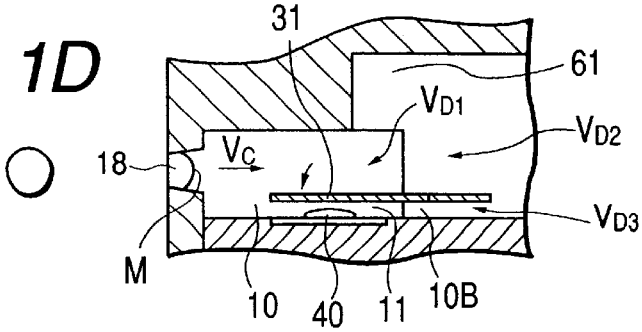

FIG. 1D shows a state where the bubble 40, after the above described film boiling, shrinks to disappear with reducing pressure in the bubble. When the bubble disappears, in order to compensate for the shrunken volume of the bubble in the bubble generating region 11, and the discharged volume of the liquid, liquid flows in to the upstream namely like flows $V_{D1}$, $VD_{D2}$, $VD_{D3}$ from the side of the common liquid chamber 13, or a flow $V_C$ from the side of the discharging port.

Figure 1E:
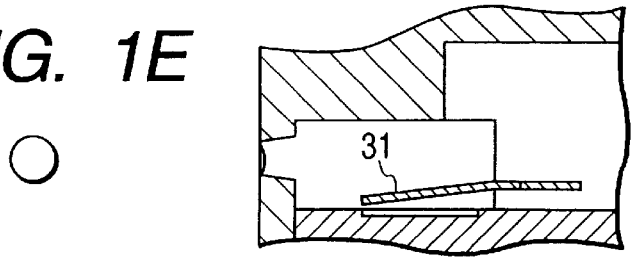

FIG. 1E shows a state where the movable member 31 comes down from the initial position (first position) after disappearance of the bubble 40. In this way, the movable member 31 which has been displaced to a second position returns to the initial position (first position) in FIG. 1A by negative pressure due to shrinkage of the bubble and stability due to elasticity of the movable member per se.

Operation of the movable member and discharging operation of liquid associated with the generation of a bubble have been above described, refilling of liquid to the liquid discharging head applicable to the present invention will be described hereunder in detail.

In a state after FIG. 1C, when the bubble 40 proceeds into the bubble disappearance process after reaching a state where the volume of the bubble is maximum, liquid in a volume to compensate the volume of the bubble disappeared flows into the bubble generating region 11 from the side of the discharging port 18 of the liquid flow path 10 and the upstream of the bubble generating region 11. In the conventional liquid flow path structure which lacks the movable member 31, the volume of liquid which flows in from the side of the discharging port to the bubble disappearing position and the volume of liquid which flows in from the common liquid chamber are dependent on the magnitude of the flow resistance at a part nearer to the discharging port than the bubble generating region and a part near to the common liquid chamber (based on the flow path resistance and inertia of the liquid).

Because of the reason, when the flow resistance on a side near to the discharging port is small, a large volume of liquid flows in from the side of the discharging port to the bubble disappearing position causing increase in meniscus retreat volume. Specifically, if the flow resistance of the side near to the discharging port is more reduced in order to improve the discharging efficiency, retreat of meniscus M at the time of bubble disappearance increases, causing elongation of refilling time, and high speed printing has been hindered.

As a countermeasure thereto, the movable member 31 is provided in the present structure, and as the result, when the volume W of a bubble is divided into an upper side $W_1$ of the first position and a side of $W_2$ of the bubble generating region, retreat of the meniscus substantially ceases at time point when the removable member returns to the initial position at the time of bubble disappearance, and the liquid feeding in the volume of $W_2$ left thereafter is performed by the liquid feeding mainly from the flow $V_{D3}$ of a second liquid flow path 10*b*. By this way, the meniscus retreat volume, which has conventionally been a quantity equivalent to more or less half of the volume of the bubble W, can be reduced to approximately one half of $W_1$, much reduced from the conventional quantity. Further, as liquid feeding in the volume of $W_2$ can be forcibly performed mainly from the upstream $V_{D3}$ of the bubble generating region 11, along a face of the side of the heat generating member of the movable member 31 taking advantage of the pressure at the time of bubble disappearance, faster refilling can be realized.

Further, in the present invention, liquid feeding $V_{D1}$ from the upper wall lacking region 61 achieves extremely significant advantage, as described above. In the region, as the upper wall 60 and the side wall 62 are lacking, flow resistance is very small and high feeding performance can be obtained. More specifically, the structure yields better efficiency with high density nozzle arrangement which has narrow side wall width. The region has no side wall partitioning a plurality of liquid flow paths and defines a common communication space with which the liquid flow paths are commonly communicated.

Further, what is characteristic is, when refilling is performed using pressure of the bubble disappearance time by a conventional head, vibration of meniscus is enlarged leading to deterioration of the image quality, but in high speed refilling with the present structure, the movable member inhibits circulation of liquid at the side of the discharging port of the region of the liquid flow path 10 on the side of the discharging port side and the bubble generating region 11, and meniscus vibration can be dramatically reduced.

In this way, the above described structure to be applied to the present invention has feature of forcible refilling to a liquid flow path and a bubble generating region from region lacking upper wall, and high speed refilling by meniscus retreat or vibration inhibition, and the feature can be used in realizing stabilized discharging and high speed repetitive discharging, and when used in a field of recording, improvement in image quality and high speed recording. Meantime, a nozzle in the present invention indicates a liquid flow path 10 from the orifice to the upstream of the side wall 62, and the upper wall lacking region 61 having the side wall 62 is not included therein.

The above described structure which is applied to the present invention is further provided with effective function as follows. The function is to inhibit propagation (back wave) toward the upstream of the pressure due to generation of the bubbles. -The bubbles generated on the heat generating member 2 generate pressure, but the pressure due to the bubbles on the side of the common liquid chamber 13 (the upstream side) has mostly caused a force (back wave) to push back liquid toward the upstream. The back wave causes pressure on the upstream, liquid traveling volume due to the pressure, and inertia associated with the liquid traveling, all of which causes deterioration of refilling of liquid into a liquid flow path, which also hinders high speed driving of the apparatus. In the present structure, the movable member 31 inhibits such actions toward the upstream, which further improves feeding characteristic in refilling.

Further characteristic structure and advantage will be described from now on.

A second liquid flow path 10*b* comprises a flow path having an inner wall substantially connected evenly with the heat generating member 2 in the upstream of the heat generating member 2 (surface of the heat generating member is not largely sunken). In a case like this, liquid feeding to the bubble generating region 11 and the surface of the heat generating member 2 is performed along a face on side near to the bubble generating region 11 of the movable member 31 like $V_{D3}$. In the situation, liquid is inhibited from being stayed on the surface of the heat generating member 2, gas dissolved in the liquid is easily precipitated, bubbles left being not disappeared or so-called residual bubbles are easily removed, and heat storage in liquid can be restricted within a limit. Accordingly, bubbles can be repetitively generated in more stabilized way in high speed. Meanwhile, in the present embodiment, description has been made with a liquid discharging head comprising a liquid flow path having substantially flat inner wall, but this does not constitute any limitation to the present invention and other types of liquid flow path which is smoothly connected with the surface of the heat generating member and has smooth inner wall can work in the same way, and a liquid flow path in any shape that inhibits staying of the liquid over the heat generating member and large disturbance in the liquid feeding may suit to the object of the present invention.

Figure 5:
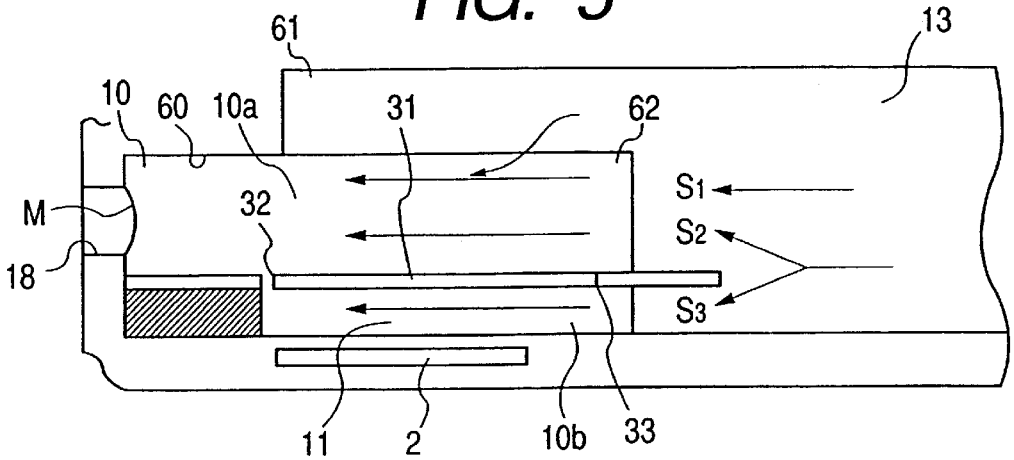
FIG. 5 is a schematic side sectional view for describing a liquid flow in a liquid discharging head of the present invention.

By the way, looking at the positions of the free end 32 of the movable member 31 and the fulcrum 33, the free end is positioned, for example, as indicated in FIG. 5, relatively downstream to the fulcrum. On account of such structure, function and advantage in leading the pressure propagation direction and the growth direction of the bubble at the time of above described generation of bubble toward the discharging port and the like, can be efficiently realized. Further, the positional relationship not only achieves function and advantage relative to the discharging, but also is capable of reducing flow resistance relative to the liquid flowing in the liquid flow path 10, when liquid is being fed, to achieve advantage that refilling can be performed in high speed. This is because, as illustrated in FIG. 5, the free end 32 and the fulcrum 33 are arranged in such a way that the free end and the fulcrum are not resisting to flows $S_1$, $S_2$, and $S_3$ which flow in the liquid flow path 10 (including a first liquid path 10*a*, and a second liquid flow path lob), when meniscus M retreated by discharging is returned to the discharging port 18 by virtue of capillarity, and when liquid is fed to the disappeared bubbles.

To supplement the above description, in FIGS. 1A to 1E illustrating the present structure, the free end 32 of the movable member 31, as above described, extends relative to the heat generating member 2 in such a way that the free end opposes to the position of the downstream relative to the area center 3 (a line passing through the area center (middle) of the heat generating member and orthogonally crossing the lengthwise direction of the liquid flow path) which divides the heat generating member 2 into an upstream region and a downstream region. On account of this arrangement, pressure or a bubble which greatly contributes to the discharging of liquid generated on the side downstream relative to the area center position 3 of the heat generating member, is received by the movable member 31, and the pressure and the bubble can be led toward the discharging port, resulting fundamental improvement in discharging efficiency and discharging force. Further, the side upstream of the above described bubble is used in addition to bring about a multiplicity of advantage. Further, it is considered that, in the present structure, instantaneous mechanical displacement of the free end of the movable member 31 is making effective contribution to liquid discharging. [First Embodiment]

A first embodiment is described with reference to FIGS. 1A to 1E. In the present embodiment, major principle on discharging liquid is also the same as the previous description.

In the present embodiment, as illustrated in FIGS. 1A to 1E, in order to prevent a liquid flow due to a pressure wave associated with generation of bubbles in a bubble generating region 11 positioned between a movable member 31 and a heat generating member 2, to reach a neighboring nozzle, a side wall 62 is formed to the further upstream of the trailing end of the heat generating member 2. Further, the upstream of the side wall 62 extends to a common liquid chamber 13, and a wall lacking region 61 is formed thereabove.

By this arrangement, in a bubble growth process as illustrated in FIG. 1C, by displacement of the movable member 31, the movable member 31 and the wall 62 block or inhibit the flow of liquid to a nozzle disposed in the upstream and in the neighborhood, and inhibits traveling of the liquid toward the upstream. As a result of this arrangement, retreat volume of meniscus in a bubble disappearance process of the bubble 40 is reduced. Further, the movable member 31 ceases to displace on the way when the movable member hits an upper wall 60 of the nozzle or a structure (protrusion or the like) in the nozzle, or because of rigidity of the movable member per se, and traveling of the liquid toward the upstream in the bubble growth process and toward the neighboring nozzle can be effectively inhibited.

In the bubble shrinkage process as illustrated in FIG. 1D, as liquid ($V_{D1}$) is fed also from upper part of the bubble generating region 11, flow resistance of the liquid generated by the side wall 62 is substantially disappeared, and refilling to the nozzle can be completed quite in a short time. Therefore, feeding efficiency is dramatically improved compared with the conventional nozzle where the upper wall 60 of the nozzle is extending to the same position as the trailing end of the side wall.

In this way, according to the liquid discharging head of the present invention, in comparison with the conventional nozzle, traveling of liquid toward the upstream is suppressed, and refilling frequency (reciprocal of time from bubble generation to the return of meniscus to the orifice) is improved due to improved feeding. Further, because of the free end 32 of the movable member 31 being extended to the downstream of the heat generating member 2, growth of the bubble 40 can be led toward the discharging port causing improvement in discharging force. Meantime, a nozzle in the present invention indicates a liquid flow path 10 from the orifice to the upstream of the side wall 62, and the upper wall lacking region 61 having the side wall 62 is not included therein.

[Second Embodiment]

A second embodiment will be described referring to FIGS. 6A to 6E.

In the present embodiment, in addition to the structure of the first embodiment, as illustrated in FIGS. 6A to 6E, a movable member 31 is retracted to the vicinity of the center of a heat generating member 2. The upstream of the side wall 62 is extended to the inside of a common liquid chamber 13, and the upper wall lacking region 61 is formed thereabove.

Figure 6A:
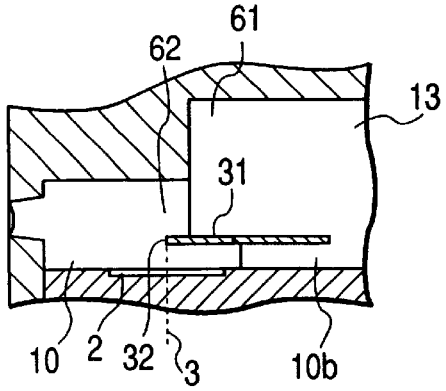
FIGS. 6A, 6B, 6C, 6D and 6E show schematic side sectional views of a liquid discharging head in a second embodiment of the present invention and similar views of driving aspects of the discharging head.
Figure 6B:
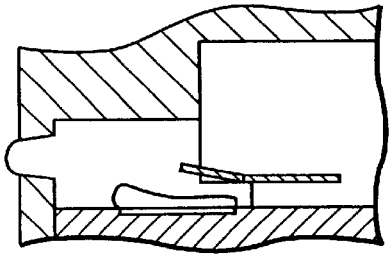
Figure 6C:
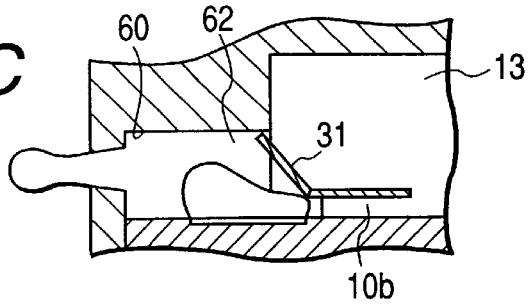

By this arrangement, in the bubble growth process as illustrated in FIG. 6C, by displacement of a movable member 31, movable member 31 and the side wall 62 block or inhibit the liquid flow to the neighboring nozzle from the upstream and a second liquid flow path 10*b*, and the liquid travel toward the upstream is inhibited. As a result, of this arrangement, retreat volume of meniscus in the bubble disappearance process of the bubble 40 is reduced. Besides, the movable member 31 ceases to displace on the way, when the movable member hits the upper wall 60 of the nozzle or the structure (protrusion or the like) in the nozzle, or by rigidity of the movable member per se, and the liquid travel in the bubble growth process to the upstream or toward the neighboring nozzle can be effectively inhibited.

Figure 6D:
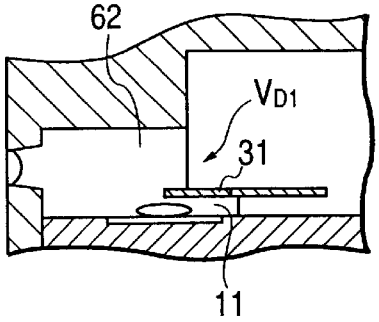
Figure 6E:
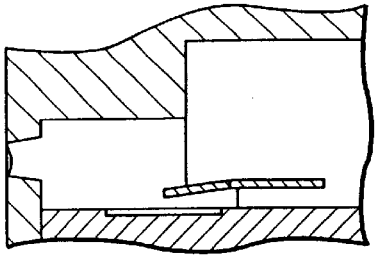

In a bubble shrinkage process as illustrated in FIGS. 6A to 6E, as liquid ($V_{D1}$) is fed from the upward of the bubble generating region 11, flow resistance of liquid generated by the side wall 62 mostly disappears, and refilling to the nozzle can be completed quite in a short time. Accordingly, in comparison with the conventional nozzle in which the upper wall of the nozzle is extended to the same position as the trailing end of the side wall, feeding efficiency can be dramatically improved. More specifically, in the present embodiment, in a bubble shrinking state as illustrated in FIG. 6D, as structure is made that the liquid flow from the upward of the bubble generating area 11 gives only limited influence to the side wall 62 and the movable member 31, flow resistance in the upstream is extremely small, enabling liquid ($V_{D1}$) to be easily fed, thus the refilling frequency is improved more than the case with the first embodiment. Further, as the side wall mainly exists in the bubble generating region 11, and the side wall is somewhat shorter in the flow path 10, refilling characteristic is the more improved.

[Third Embodiment]

A third embodiment will be described with reference to FIGS. 7A to 7E.

Figure 7A:
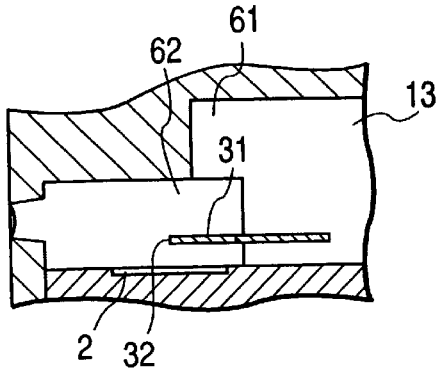
FIGS. 7A, 7B, 7C, 7D and 7E show schematic side sectional views of a liquid discharging head in a third embodiment of the present invention and similar views of driving aspects of the discharging head.
Figure 7B:
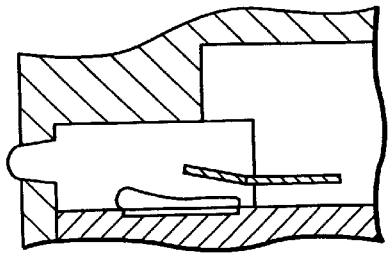

The present embodiment is, in the same way as the first embodiment, as illustrated in FIG. 7A, a side wall 62 is raised the height thereof on the side of the upstream to the height to which the movable member 31 displaces, the end thereof is extended to the common liquid chamber 13, and the wall lacking region 61 is formed thereabove. Similarly with the second embodiment, the free end 32 of the movable member 31 is receded to the vicinity of the center of the heat generating member 2.

Figure 7C:
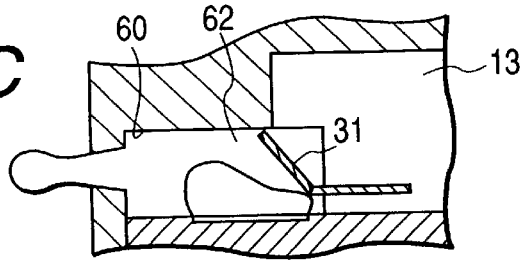
Figure 7D:
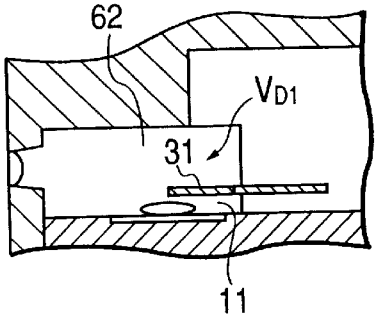
Figure 7E:
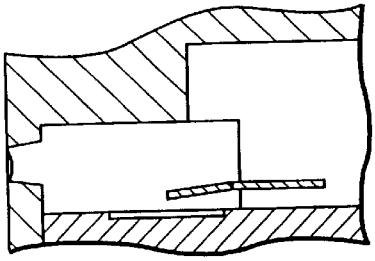

By this arrangement, in the bubble growth process as illustrated in FIG. 7C, by displacement of the movable member 31, movable member 31 and the side wall 62 block or inhibit the liquid flow to the nozzle in the upstream and in the neighborhood, and crosstalk is reduced, and the liquid travel toward the upstream is inhibited. Further, in the present embodiment, in the bubble shrinking state as illustrated in FIG. 7D, liquid ($V_{D1}$) is fed from the bubble generating region 11, not excessively influenced by the side wall 62 and the movable member 31. Further, as the movable member 31 does not exist in the downstream of the bubble generating region 11, flow resistance is small with resultant improvement in refilling frequency and the discharging efficiency more than the first embodiment.

[Fourth Embodiment]

A fourth embodiment will be described referring to FIGS. 8A to 8E.

Figure 8A:
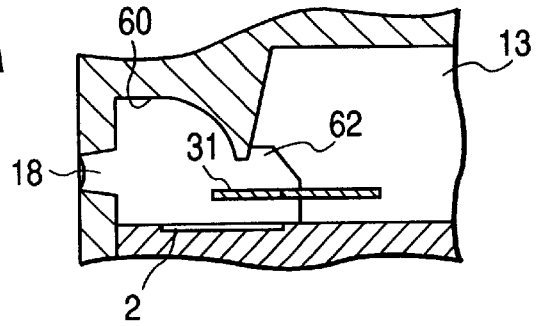
FIGS. 8A, 8B, 8C, 8D and 8E show schematic side sectional views of a liquid discharging head in a fourth embodiment of the present embodiment and similar views of driving aspects of the discharging head.
Figure 8B:
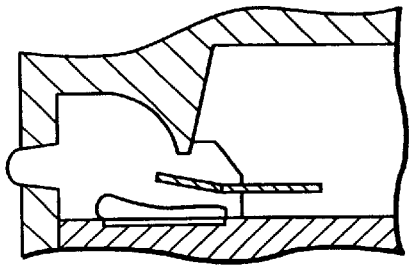

In this embodiment, similarly with the third embodiment, as illustrated in FIG. 8A, the side wall 62 is raised the height thereof on the side of the upstream to the height to which the movable member 31 displaces, but the upper part of the trailing end of the side wall 62 is obliquely cut to improve the more both the blocking properties against the upstream and the neighborhood and the refilling properties. Further, the upper wall 60 is raised in the downstream the higher as approaches to the discharging port 18.

Figure 8C:
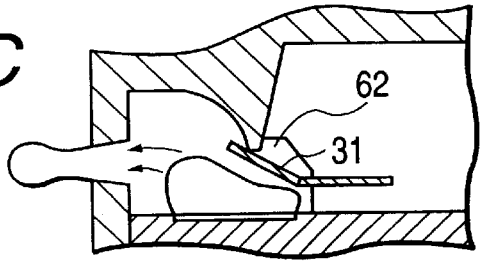
Figure 8D:
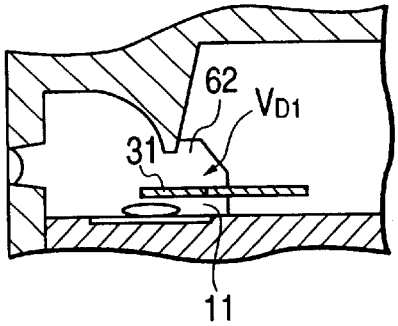
Figure 8E:
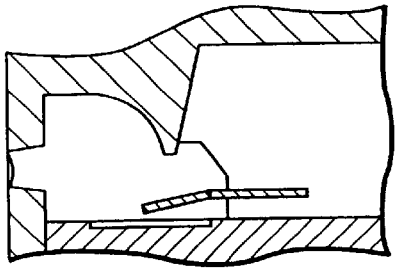

By this arrangement, in the bubble growth state as illustrated in FIG. 8C, by displacement of the movable member 31, the movable member 31 and the side wall 62 block or inhibit the liquid flow to the nozzle in the upstream and in the neighborhood to reduce crosstalk, and liquid traveling toward the upstream is inhibited, and the flow path resistance on the downstream being small, the discharging efficiency can be improved more than the third embodiment. Further, in the bubble shrinkage state as illustrated in FIG. 8D, liquid ($V_{D1}$) being fed from the bubble generating region 11 without excessive influence from the side wall 62 and the movable member 31, the refilling frequency is improved more than the third embodiment.

Further, similarly with the second and the third embodiment, the fulcrum 33 of the movable member 31 exists nearby the heat generating member in the downstream of the side wall 62, and liquid traveling volume toward the upstream at the time when the movable member 31 displaces is small, resultantly the meniscus retreat can be further inhibited. Further, such reduction of liquid traveling toward the upstream represents lesser reaction of liquid travelling toward the discharging port at the time of refilling, and the advantage further improves the refilling characteristics. Still more, influence to the neighboring nozzle is limited and the discharge instability element by the inter-nozzle crosstalk can be reduced.

[Fifth Embodiment]

Materials of the composing members of the liquid discharging head in the above described embodiments 1 to 4 are selected depending on use situation of the materials, but improvement in reliability of the characteristic feature of the movable member, and the structure of flow path and liquid chamber, in the high density arrangement where thermal expansion conditions are made to be consistent is important. Then, a liquid discharging head having composing members corresponding to the object will be described.

Figure 9:
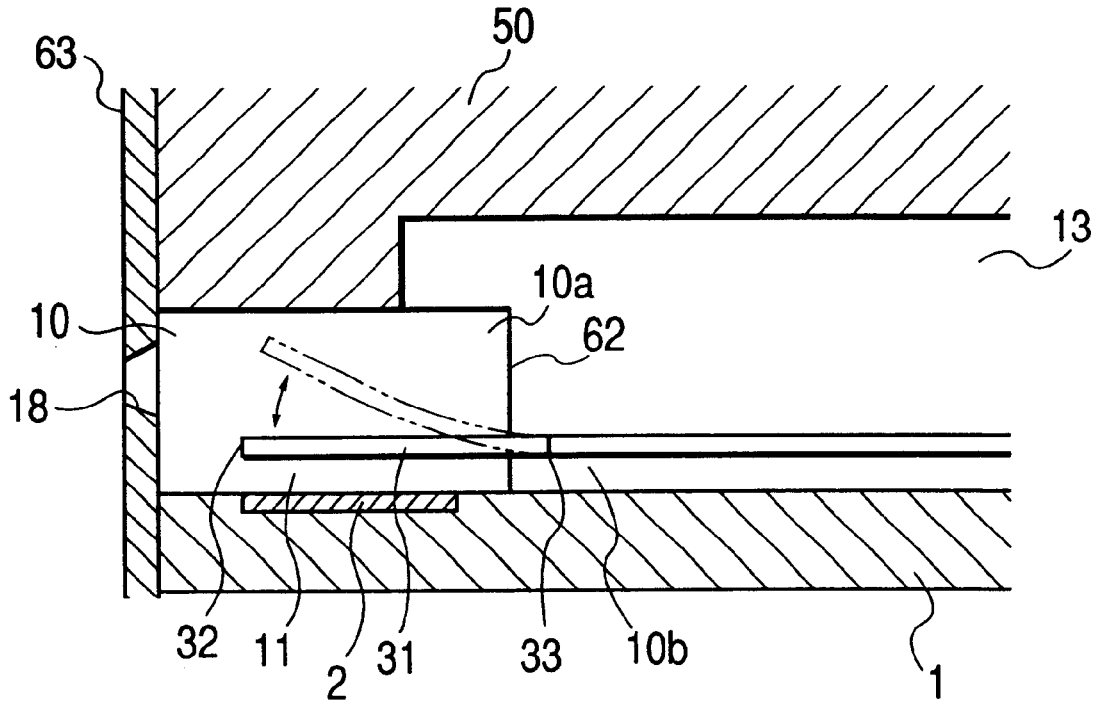
FIG. 9 is a schematic side sectional view showing a liquid discharging head in a fifth embodiment of the present invention.
Figure 13A:
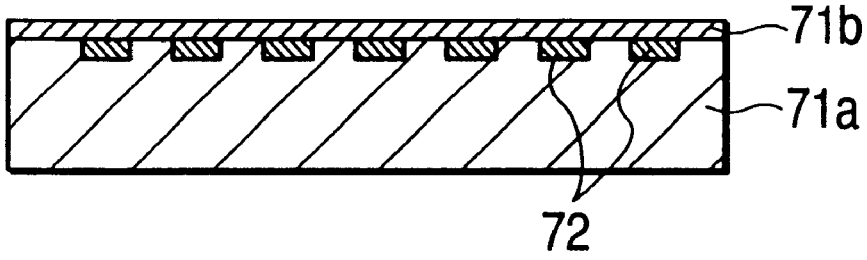
FIGS. 13A and 13B show process flow diagrams of an example of a manufacturing method for an element substrate of a liquid discharging head of the present invention.
Figure 13B:
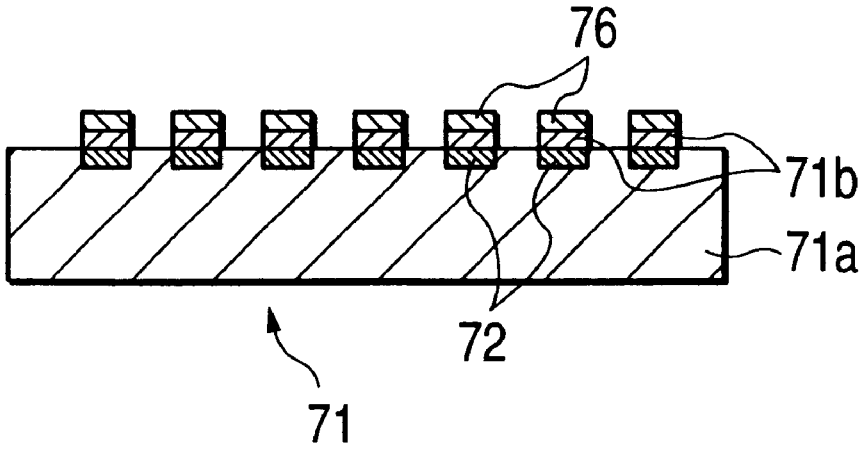

FIG. 9 is a sectional view along the liquid flow path direction of a liquid discharging head for describing basic structure of the liquid discharging head in a fifth embodiment of the present invention. As illustrated in FIG. 9, the liquid discharging head comprises an element substrate 1 having a plurality (only one is shown in FIG. 9) of heat generating member 2 arranged in parallel for giving thermal energy to liquid for generating bubbles, a roof 50 seamed onto the element substrate 1, and an orifice plate 63 seamed onto the front end faces of the element substrate 1 and the roof 50.

The element substrate 1 is a substrate of silicon or the like on which silicon dioxide film or silicon nitride film is applied for insulation and heat storage, and electric resistor layer and wiring are provided thereon by being subjected to patterning for composing the heat generating member 2. Voltage is applied to the electric resistor layer from the wiring, and the heat generating member 2 is heated when current is applied to the electric resistor layer.

The roof 50 is for composing a plurality of liquid flow path 10 corresponding to each heat generating member 2, a common liquid chamber 13 for feeding liquid to each liquid flow path 10, and a side wall 62 extending between the roof and each heat generating member 2 is provided as an integrated body. The roof 50 is composed of a material of silicon group, and can be formed by etching the portion of the liquid flow path 10, after forming the pattern of the liquid flow path 10 and the common liquid chamber 13 by etching, and piling up materials such as silicon nitride, silicon dioxide and the like to be used for forming the side wall 62 on the silicon substrate by means of known film making method such as CVD or the like.

The orifice plate 63 has a plurality of discharging ports 18, formed thereon, communicated with the common liquid chamber 13 via respective liquid flow path 10 corresponding to each liquid flow path 10. The orifice plate 63 is also made of a material of silicon group, and formed by, for example, cutting the silicon substrate by which the discharging port 18 has been formed to the thickness of 10 to 150 $\mu$m. Meantime, the orifice plate 63 is not an essential structure for the present invention, and instead of providing the orifice plate 63, and a roof with a discharging port can be formed in such a way that, when forming the liquid flow path 10 on the roof 50, a wall of the thickness equivalent to the thickness of the orifice plate 63 is left on the front edge surface of the roof 50, and the discharging port 18 is formed thereon.

Further, the liquid discharging head has a cantilever-shaped movable member 31 provided thereon, and the movable member is arranged to face to the heat generating member 2 in such a way that a first liquid flow path 10*a* communicating the liquid flow path 10 with the discharging port 18 is separated from a second liquid flow path 10*b* having the heat generating member 2. The movable member 31 is a thin film formed with a material of silicon group such as silicon nitride, silicon dioxide, or the like.

The movable member 31 has a fulcrum 10*a* on the upstream of a large liquid flow flown from the common liquid chamber 13 toward the discharging port 18 via the movable member 31 by the discharging operation of the liquid, and is dispose of at a position facing to the heat generating member 2, apart from the heat generating member 2 with a predetermined distance, and in a state to cover the heat generating member 2 so that a face end 32 may be held in the downstream relative to the fulcrum 10. The region between the heat generating member 2 and the movable member 31 is the bubble generating region 11.

As described heretofore, as the liquid discharging head of the present embodiment uses silicon nitride (SiN) as a material for each composing parts thereof, ink resisting characteristic can be improved, and a problem of mechanical characteristic associated with the difference in line expansion ratio can be solved.

Example of Liquid Discharging Head Manufacturing Method

Now, an example of manufacturing method for liquid discharging head will be described. When a liquid discharging head is manufactured by making a movable member, a nozzle wall, and an orifice plate as separate bodies, and assembling the parts on an element substrate, high density arrangement has been extremely difficult in view of the difficulty in assembling and high precision involved therein. In the present embodiment, problems of mechanical characteristic (difference in linear expansion coefficient between an element substrate and a nozzle roof, and the like) and problems in assembling (adhesion of the movable member, fixing of the nozzle roof, specifically difficulty in fixing when the roof has the movable member thereon) are solved in a breath by incorporating the above mentioned each composing element into a film making process, and high density arrangement of the heating members on the element substrate is achieved to enable realization of high density discharging nozzle.

FIGS. 10A1, 10A2 to 10F1, 10F2 and 11G1, 11G2 to 11I1, 11I2 are process flow diagrams of an example of manufacturing method for the liquid discharging head according to the present embodiment. In the Figures, FIGS. 10A1, 10B1, 10C1, 10D1, 10E1, 10F1, 11G1, 11H1 and 11I1 are front sectional views, and FIGS. 10A2, 10B2, 10C2, 10D2, 10E2, 10F2, 11G2, 11H2 and 11I2 are side sectional views.

In FIGS. 10A1 and 10A2, at first, PSG (Phospho-Silicate Glass) film 201 is formed on a substrate 208 by CVD method as the temperature condition of 350° C. Film thickness of the PSG film 201 corresponds finally to the gap between the moving section of the movable member and the heat generating member, and is controlled to take a value at which the advantage of the movable member is most remarkable, between 1 to 20 $\mu$m, in the balance of the flow path as a whole.

In FIGS. 10B1 and 10B2, then, the PSG film 201 is coated by a spin coater or the like with resist for patterning, then exposed and developed. By this processing, resist of the portion corresponding to the fixed section of the movable member is removed. Then, the PSG film 201 on the portion lacking resist is removed by wet etching with buffered hydrofluoric acid. Residual resist is then removed by plasma ashing by oxygen plasma, or by soaking into resist coating agent.

In FIGS. 10C1 and 10C2, on the substrate 208 thus processed, SiN film 202 is formed by sputtering in the thickness of 1 to 10 $\mu$m. Composition of SiN film 202 is said be best with $Si_3N_4$, but as effect on the moving members may be satisfactory when the position is in the range of Si: 1 and N: 1 to 1.5. The SiN film 202 has been generally used in semiconductor process, and has alkali-resisting and acid-resisting properties and chemical stability, and is also ink-resisting. In other words, manufacturing method for the film 202 is not restricted, in achieving the structure and the composition that realize the optimum characteristic as the material for the movable members. For example, forming method of SiN film 202 is not restricted to above mentioned sputtering, and the film can be manufactured also by atmospheric CVD, LPCVD, bias ECRCVD, microwave CVD, or coating method. Further, in making SiN film 202, percentage composition of the film is changed by stages in making multi-layer structure in order to improve the characteristic, such as physical characteristic like stress, rigidity, Young's modulus, and the like, and chemical characteristic like alkali-resisting, acid-resisting, and the like, to meet the use application. Alternatively, impurities may be added in stages to make a multi-layer structure, or impurities may be added to a single layer.

In FIGS. 10D1 and 10D2, further, in order to prevent damage to the movable member when etching a flow path wall to be formed in the next process, damage protecting film 203 is formed. Namely, when the movable member and the flow path wall are of substantially same material, the movable member may also be etched when forming the flow path wall by etching, and a protective film is required for the projection. In this embodiment, Al film being the protective film 203 is formed in the thickness of 2 $\mu$m by sputtering.

In FIGS. 10E1 and 10E2, then, in order to make the SiN film 202, and the damage protective film 203 thereon, which is Al film, in a predetermined shape, resist is coated by spin coater or the like for patterning. Then, Al film 203 and SiN film 202 are subjected to etching to the shape of the movable member by dry etching using CF4 gas or the like, reactive ion etching, or the like.

In FIGS. 10F1 and 10F2, now, SiN film 207 as material for a flow path wall and an orifice plate is formed into a thickness of 20 to 40 $\mu$m by CVD method, or by microwave CVD method when high speed film forming is particularly required. The film 207 becomes the flow path wall or the orifice portion after the patterning. The SiN film 207 is not influenced by usual film characteristic required in the ordinary semiconductor process such as, for example, pin hole density and film denseness. Namely, the film is usable as long as ink-resisting characteristic and mechanical strength are enough satisfactory as a flow path wall relative to ink, and slight increase in pin hole density by high speed film forming or the like is not mattered instead. Although the present embodiment has been described with SiN film, the material for a flow path wall is not restricted to the SiN film as is described previously, and SiN film including impurities and SiN film of different composition may be usable as long as mechanical characteristic and ink resisting characteristic are held, and diamond film, amorphous carbon hydride film (diamond carbon film), and inorganic film made of alumina group, zirconia group, or the like may be used.

In FIGS. 11G1 and 11G2, then, in order to make the SiN film 207 in a predetermined shape, resist is coated by spin coater or the like for patterning. The film is then subjected to dry etching using CF4 gas or the like, or reactive ion etching. Alternatively, ICP (inductive coupling plasma) etching is best suited for etching the thick film 207 from the stand point of high speed etching characteristic. After the etching, residual resist is removed by means of plasma ashing by oxygen plasma, or by soaking into resist removing agent. The flow path wall 204 is thus formed.

In FIGS. 11H1 and 11H2, now, the damage protective film 203 on the movable member is removed by wet etching or dry etching. Here, the method does not matter as long as the damage protective film 203 is removed. Further if the film is formed with high ink-resisting material like Ta, the film is not required to be removed, so long as the damage protective film 203 does not wrongly influence the characteristic of the movable member.

In FIGS. 11I1 and 11I2, lastly, SPG film at the bottom layer of the movable member is removed by buffered hydrofluoric acid, thus the movable member 205 is formed in the predetermined shape. To the movable member thus formed, the orifice plate 63 and the roof 50 are seamed to manufacture a liquid discharging head.

In the manufacturing method for a liquid discharging head as described above, a flow path wall and the movable member are formed on a substrate at a time, but an orifice member can also be formed at the same time. Namely, instead of forming the flow path wall 204 in the way illustrated in FIGS. 11G1, 11G2 to 11I1, 11I2, the wall of the orifice member 206 is formed at the same time in a thickness of 2 to 30 $\mu$m as illustrated in FIGS. 12G1, 12G2 to 12J1, 12J2. Then, a hole is drilled on the wall by application process by way of excimer laser. Namely, using KrF excimer laser, having photo energy of 115 kcal/mol which is larger than SiN band dissociation energy of 105 kcal/mol, molecular bond of SiN is cut off to form the discharging port 18. As this process is non-thermal, high precision processing can be performed without heat sagging nor carbonization around the processing portion.

By the above described manufacturing method, following advantage can be attained.

1. Fixing of the movable member and the roof can be performed with precision (on account of photolithography).
2. High density discharging nozzle can be manufactured. Conventionally, fixing of the movable member has been difficult, for example, with 1200 dpi.
3. Adhesion of the movable member is unnecessary, and staining by adhesive and bonding can be avoided.
4. As each composing parts are formed as an integrated body, problem of contaminants is eliminated.
5. No scars on the element substrate. Conventionally, when assembling each composing parts on the element substrate, scars are often generated.
6. When simultaneously incorporating the orifice plate, excimer laser processing can be applied.
7. By simultaneously incorporating driver Tr (LDMOS) on the element substrate, high density arrangement of the heat generating member can be achieved.

[Other Embodiment]

FIGS. 13A, 13B, 14A to 14C, 15A to 15D are diagrams illustrating manufacturing methods for a liquid discharging head according to the present invention.

First, on an element substrate 71*a* of the above described structure, PSG film 71*b* of a thickness of about 5 $\mu$m is formed (refer to FIG. 13A) using plasma CVD method, and the substrate is then subjected to patterning using known method such as photolithography or the like. Then, using $\mu$W-CVD (microwave Chemical Vapor Deposition) method, a movable member 76 composed of SiN film of about 5 $\mu$m thickness is formed. At this moment, the PSG film 71*b* and the movable member 76 are in a state that portions in the flow path 77 have been subjected to comb-shaped patterning (refer to FIG. 13B).

Figure 14A:
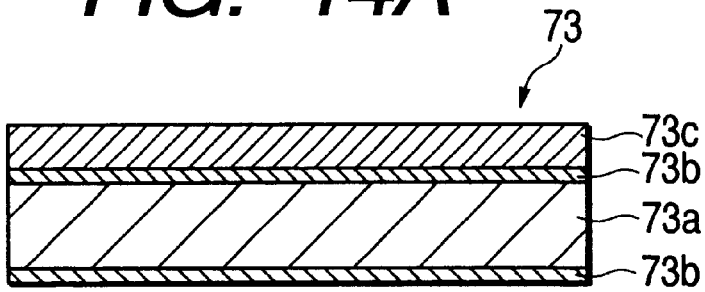
FIGS. 14A, 14B and 14C show process flow diagrams of an example of a manufacturing method for a roof of a liquid discharging head of the present invention.
Figure 14B:
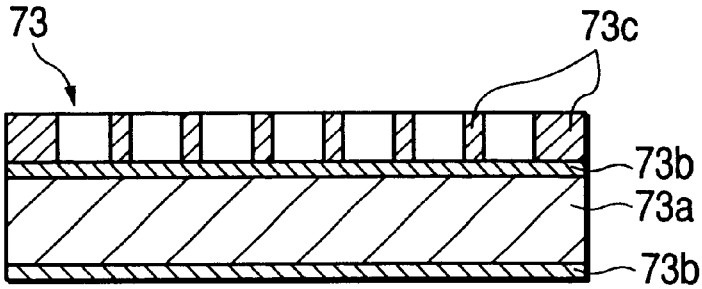
Figure 14C:
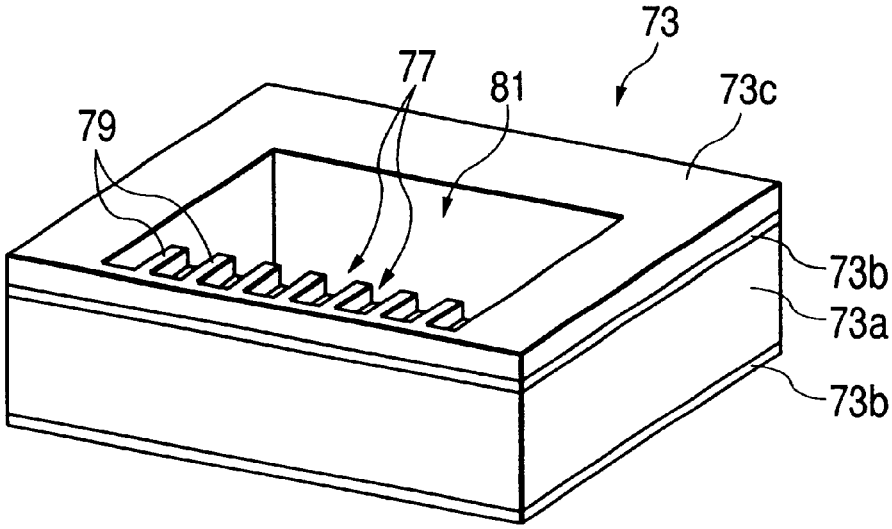

Now, after forming thermal oxidized $SiO_2$ film 73*b* of about 1 $\mu$m thick on both surfaces of a silicon wafer 73*a*, a silicon substrate to be a roof 73 is formed by patterning the portion to be a common liquid chamber using known method such as photolithography or the like. On the silicon substrate, a layer 73 of SiN or the like to be flow path side wall 79 is formed in a thickness of about 20 $\mu$m by $\mu$W-CVD method (refer to FIG. 14A). Then, using known method such as photolithography or the like, the orifice portion and the flow path portion are subjected to patterning, and etched into trench structure using etching device by means of inductive coupling plasma. Thereafter, using TMAH (tetra methyl ammonium hydroxide), the substrate is subjected to silicon wafer break-through etching to complete a silicon roof 73 which is integrated with an orifice plate (refer to FIG. 14B). FIG. 14C is a perspective view of a completed roof 73.

Figure 15A:
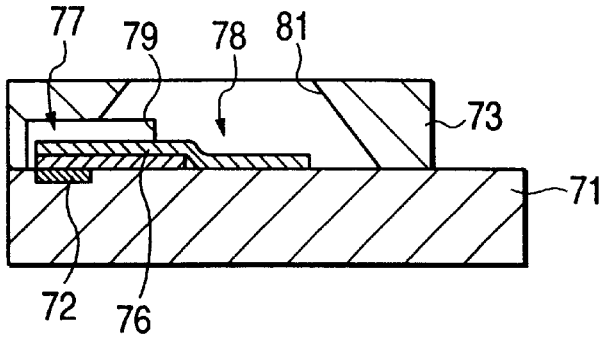
FIGS. 15A, 15B, 15C and 15D show examples of a manufacturing method for a liquid discharging head of the present invention and particularly process flow diagrams showing processes after joining an element substrate with a roof.
Figure 15B:
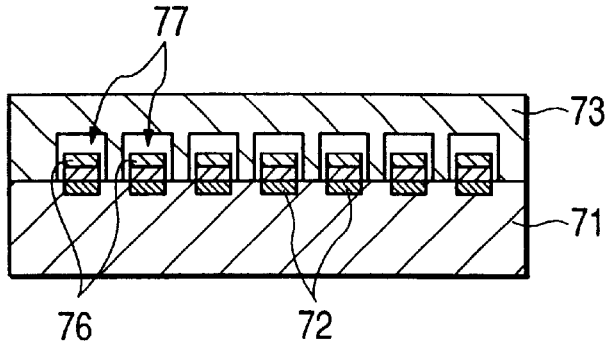
Figure 15C:
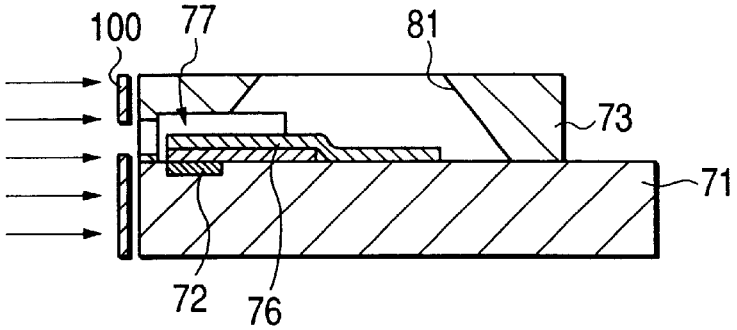

Cavitation resisting film which is at the seaming portion of the roof 73 with the element substrate 71, is subjected to patterning using known method such as photolithography or the like. Then, the seaming portions of the element substrate 71 and the roof 73 are irradiated by Ar gas or the like in vacuum atmosphere to make the surfaces of the seaming portions into active state, the portions are seamed at the room temperature, as illustrated in FIGS. 15A, 15B. FIG. 15A is a side sectional view illustrating a state where the element substrate 71 and the roof 73 are seamed together, and FIG. 15B is a front sectional view thereof. As can be seen from FIG. 15B, the liquid flow path 77, the common liquid chamber 78, and the feeding port 81 are formed on the roof 73, at the time when both the substrate and the roof are seamed together, but the orifice 75 is still to be formed. Now, as illustrated in FIG. 15C, the orifice 75 is formed by ion beam processing by means of a mask 100 in the vacuum atmosphere (refer to FIG. 15D). Then, in order to form a gap for producing an initial bubble generating region between the heat generating member and the movable member, the PSG film 71*a* is removed by wet etching method. In this way, a liquid discharging head is manufactured.

In the present embodiment, ink is discharged only from a discharging head which is communicated with a liquid flow path with a driven heat generating member provided thereon. Further, the element substrate 71, the roof 73, and the movable member 76 are all formed of material containing silicon, and as the thermal expansion coefficients of the members are substantially same, even if the temperature thereof is increased associated with high speed printing, relative to positional precision and adhesive properties of each member are maintained, enabling stabilized ink discharging in wide temperature range, and high quality printing is possible in high efficiency. Further, as the seaming of the substrate is performed without using adhesives, variation of the flow path resistance and deterioration of discharging performance due to sagging of the adhesives into the liquid flow path can be prevented. Meantime, if the element substrate 71 and the roof 73 are formed with material containing silicon, and more particularly with inorganic compound such as silicon nitride or the like, the substrate and the roof can be formed in high density with easy processing.

FIGS. 16A to 16E and 17A to 17C illustrate other examples of manufacturing method for the liquid discharging head. Now, only points which are different from the previous examples will be described. FIGS. 16A to 16D are front sectional views, FIG. 16E and FIGS. 17A to 17C are side sectional views.

After forming PSG film 71*b* of about 5 μm thick on the substrate 71*a* (refer to FIG. 16A), the substrate is subjected to patterning using known method such as photolithography or the like. Then, a movable member 76 comprising SiN film of about 5 μm thick is formed using μW-CVD method. The PSG film 71*b* and the movable member 76 are in a state where only the portion of the liquid flow path 77 has been subjected to comb-shaped patterning (refer to FIG. 16B). An etching stop layer (not shown) composing of a metal film of 1000 Å thick is formed thereon by sputtering method or evaporation method. Then, the SiN film 71*c* layer, where the orifice 75 and the liquid flow path 77 are to be formed, is formed in a thickness of about 20 μm using μW-CVD method (refer to FIG. 16C). Now, using known method such as photolithography or the like, the orifice portion and the liquid flow path portion are subjected to patterning, and the trench structure is etched using etching device by means of inductive coupling plasma, using the metal film as the etching stop layer. In this way, the element substrate 82 is completed (refer to FIGS. 16D, 16E).

On the other hand, on the roof 83 composed of material containing silicon, a common liquid chamber 81 is formed by silicon wafer break-through etching by means of TMAH. The element substrate 82 and the roof 83 are seamed together by the room temperature seaming similarly with a previous example (refer to FIG. 16A).

Then, the orifice 75 is formed by excimer laser processing (refer to FIG. 16B) using the mask 100. Now, in order to form a gap to be an initial bubble generating region between the heat generating member 72 and the movable member 76, a liquid discharging head is completed by removing the PSG film 71*b* by wet etching method (refer to FIG. 16C). In this way, in the present embodiment, a liquid flow path 77*b* and a common liquid chamber 81 are provided on the side of the element substrate 82, not on the roof 83.

Figure 15D:
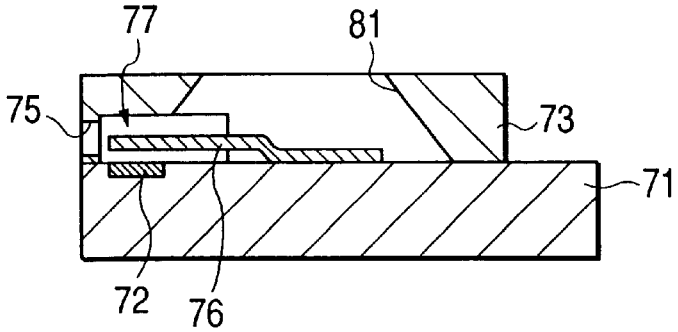
Figure 16A:
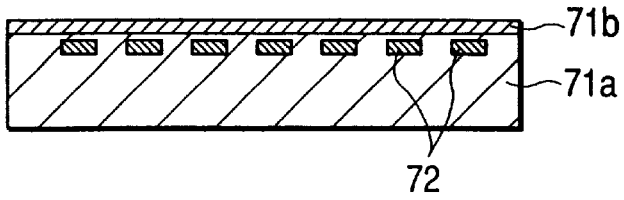
FIGS. 16A, 16B, 16C, 16D and 16E show process flow diagrams of another example of a manufacturing method for a liquid discharging head of the present invention.
Figure 16B:
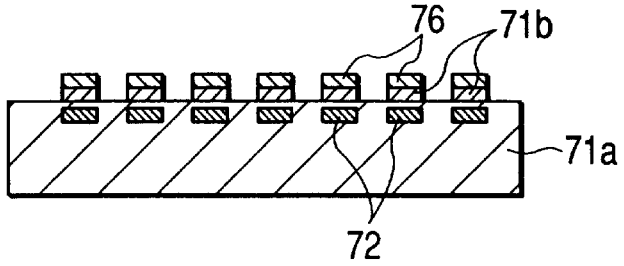
Figure 16C:
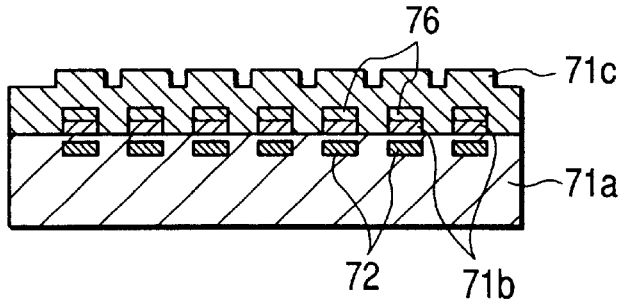
Figure 16D:
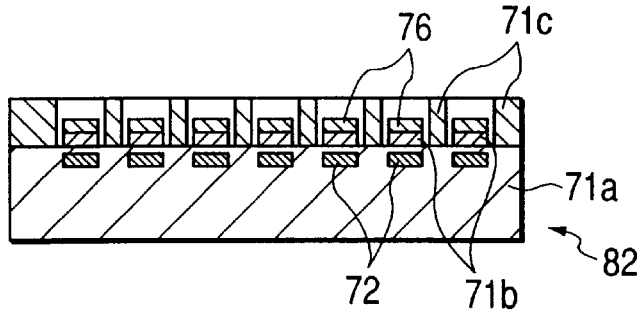
Figure 16E:
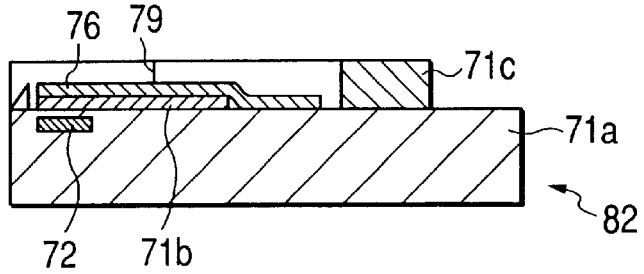
Figure 17A:
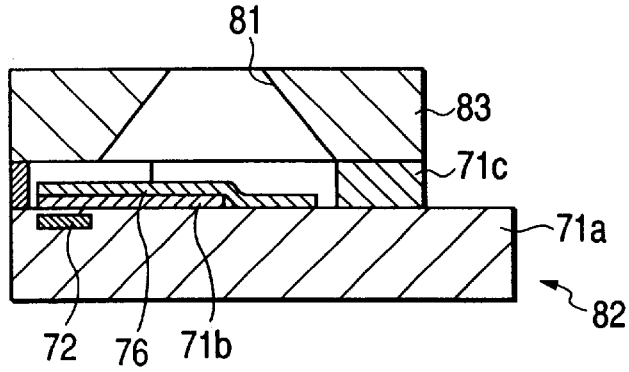
FIGS. 17A, 17B and 17C show process flow diagrams of still another example of a manufacturing method for a liquid discharging head of the present invention.
Figure 17B:
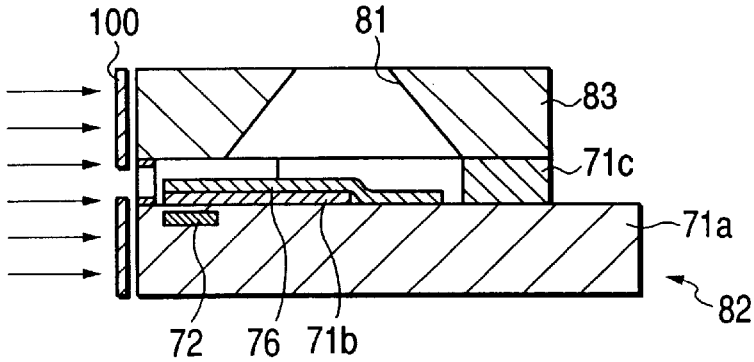
Figure 17C:
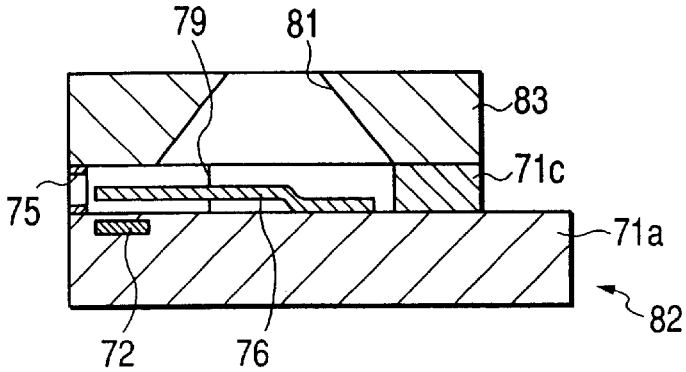

The liquid discharging head in the form as illustrated in FIG. 15D, or FIG. 17C is extremely advantageous in the following points. The liquid discharging head is provided with a cantilever-shaped movable member 76, arranged facing to the heat generating member 72, and directly secured to the element substrate 71. The movable member 76 has a curvature, and the movable section of the movable member 76 is disposed to have a predetermined slit relative to the substrate by the curvature. By making the movable member in such shape, the movable member can be firmly secured, and as a pedestal is no more required in forming the slit, the space conventionally occupied by the pedestal can be used as a part of the liquid chamber, and volume of the liquid chamber is easily secured. Further, when the movable member is made in the above mentioned structure, the movable member is required to have more strength than the conventional structure, and the movable member 76 in the present invention is made of thin film formed with material of silicon group or the like such as silicon nitride, silicon dioxide, or the like. As these materials are superior to nickel in strength which has conventionally been used as material for the movable member, and are superior in adhesive properties with insulating protective layer provide on the surface of the substrate, the materials can demonstrate stabilized characteristic in the above-mentioned structure.

FIGS. 18A, 18B, 19A to 19C, 20A to 20E further illustrate other examples of manufacturing method for a liquid discharging head. The present examples have structure similar to the previous examples, but thin film 84, which is integrated seaming section 84*a* and a plurality of movable member 84*b*, is used. The thin film may be formed of material containing silicon such as SiN, SiC, or the like, and metals of which thermal expansion coefficient is brought nearer to that of Si such as Ni, W, Ta, Pb, Mo, Cr, Mn, Fe, Co, Cu, or the like may be used as the material.

Figure 18A:
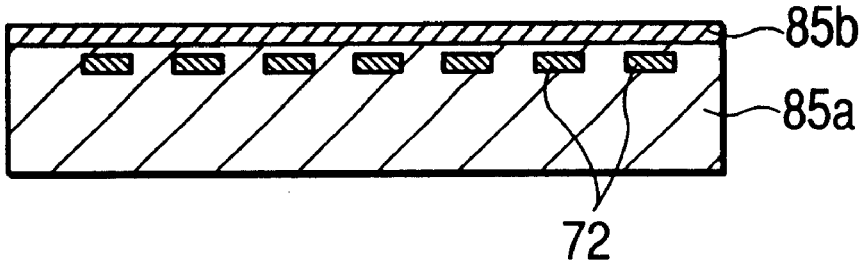
FIGS. 18A and 18B show process flow diagrams of still another example of a manufacturing method for an element substrate of a liquid discharging head of the present invention.
Figure 18B:
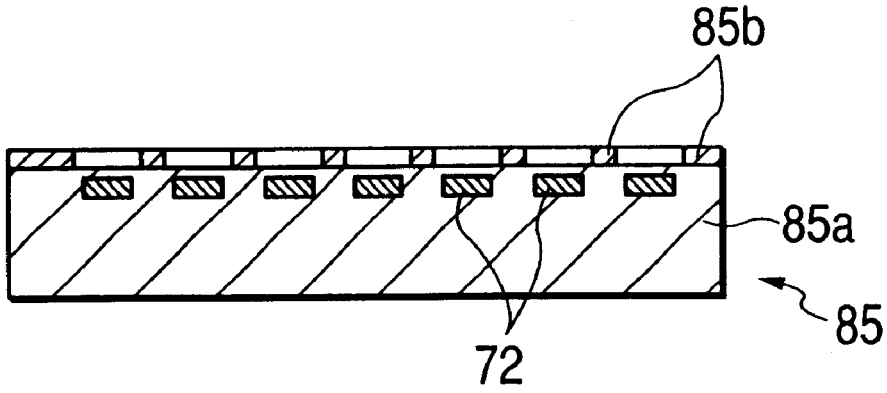
Figure 19A:
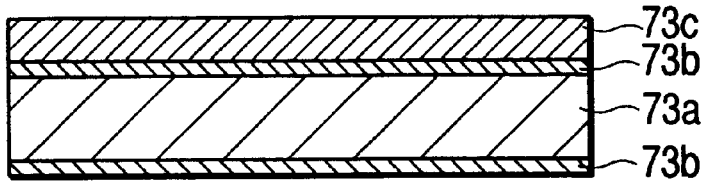
FIGS. 19A, 19B and 19C show process flow diagrams of still another example of a manufacturing method for a roof of a liquid discharging head of the present invention.
Figure 19B:
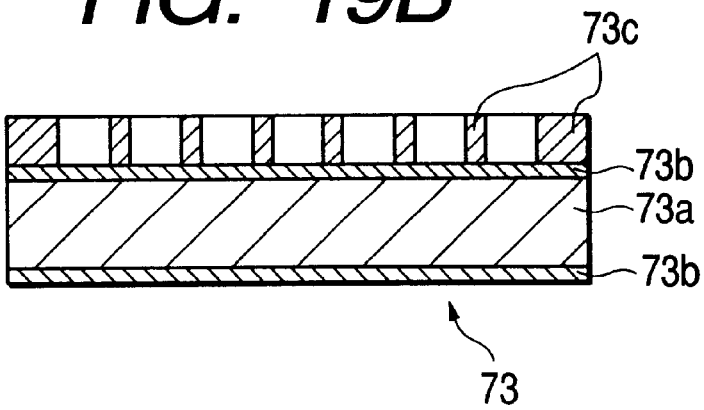
Figure 19C:
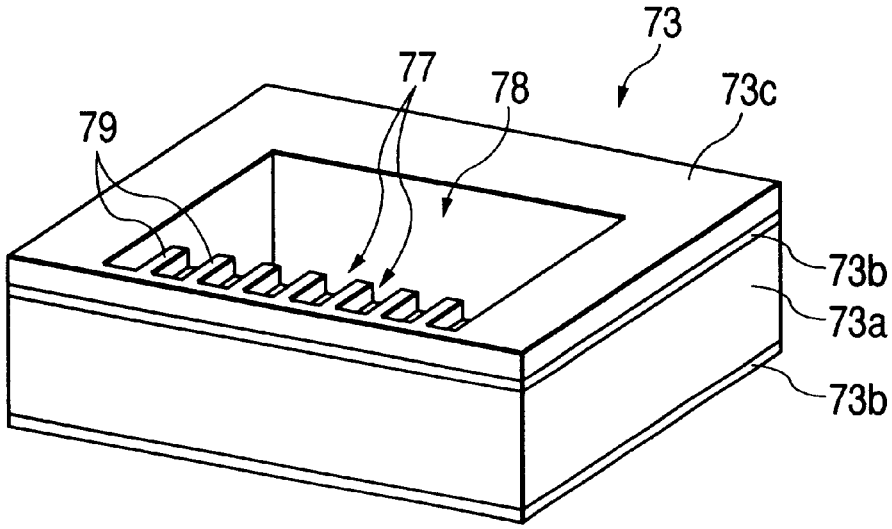

In other words, after forming SiN film 85*b* on a base substrate 85*a* (refer to FIG. 18A), only lower portion of the movable member located nearby a heat generating element is subjected to patterning to form an element substrate 85 (refer to FIG. 18B). On the other hand, after forming thermally oxidized $SiO_2$ film 73*b* of about 1 μm thick on both surfaces of the silicon wafer 73*a,* a portion to be a common liquid chamber is subjected to patterning by known method such as photolithography or the like to form a silicon substrate. Then, on the silicon substrate, a film layer 3*c* of SiN or the like to be a flow path side wall 9 is formed in a thickness of about 20 μm by μW-CVD method (refer to FIG. 19A), orifice portion and liquid flow path portion are subjected to patterning using known method of photolithography or the like, and a trench structure is subjected to etching using a etching device by means of inductive coupling plasma. Thereafter, using TMAH, the silicon substrate is subjected to silicon wafer break-through etching to complete a roof 73, which is integrated with the orifice place into an integrated body (refer to FIG. 19B). FIG. 19C is a perspective view showing the completed roof 73.

Figure 20A:
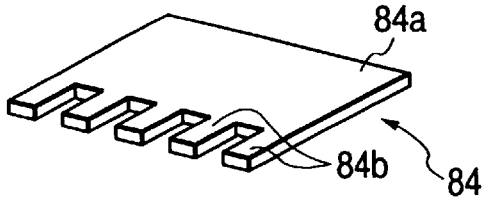
FIGS. 20A, 20B, 20C, 20D and 20E show still other examples of a manufacturing method for a liquid discharging head of the present invention, and more particularly process flow diagrams for processes after joining an element substrate with a roof.
Figure 20B:
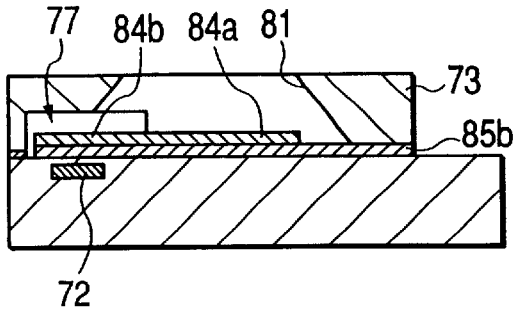
Figure 20C:
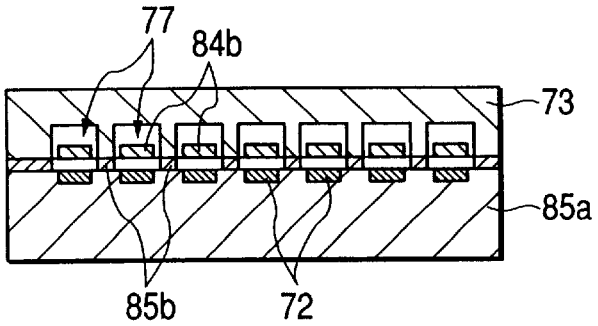
Figure 20D:
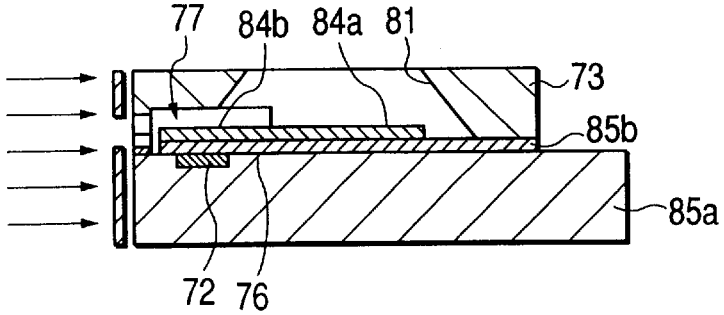
Figure 20E:
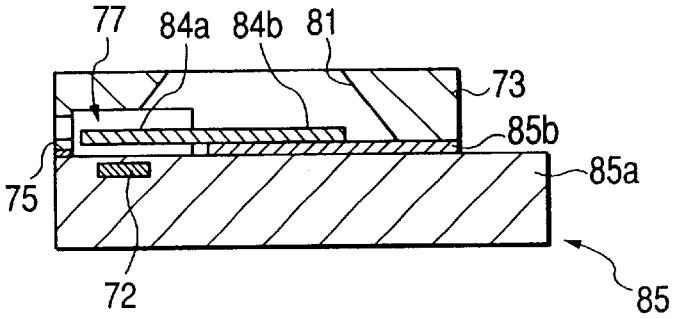

Then, seaming portions of the element substrate 85, the roof 73, and thin film 84 illustrated in FIG. 20A are irradiated by Ar gas or the like in vacuum atmosphere to make the surfaces thereof to be active state, and the element substrate 85 and the roof 73 are laminated via the thin film 84 and seamed under the room temperature. FIG. 20D illustrates a side sectional view of the element substrate 85 and the roof 73 in a state seamed together. Then, as illustrated in FIG. 20E, ion beam processing is performed using the mask 100 in vacuum atmosphere to form the orifice 75. In this way, by the power of ion beam, the orifice 75 is formed (refer to FIG. 20E). Then, in order to form a gap to be an initial bubble generating region between the heat generating member and the movable member, the PSG film 85*b* is removed by wet etching method. Thus, a liquid discharging head of the present embodiment is completed.

Movable Member and Separation Wall

Figure 21A:
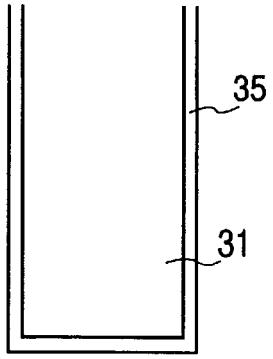
FIGS. 21A, 21B and 21C show schematic top views of other shapes of a movable member.
Figure 21B:
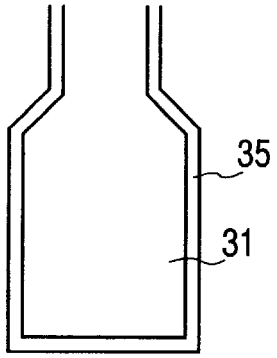
Figure 21C:
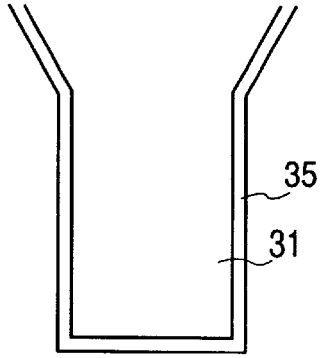

FIGS. 21A to 21C illustrates other shapes of the movable member 31 and numberal 35 is a slit provided in a separation wall, by which the movable member 31 is formed. FIG. 21A is a rectangular shape, FIG. 20B is a shape in which fulcrum side is made narrow to enable easier operation of the movable member, and FIG. 20C is a shape in which fulcrum side is made wide to improve durability of the movable member.

In some previous embodiments, the plate-shaped movable member 31 and the separation wall 30 having the movable member thereon are composed of nickel of 5 μm thick, but the material is not restricted thereto and any material which has solvent-resisting properties, and elasticity for advantageous operation of the removable member, and which allows forming of fine slit thereon, may be suited as material to compose the movable member and the separation wall.

Desirable materials for the movable member 31 are metals of high durability such as silver, nickel, gold, iron, titanium, aluminum, platinum, tantalum, stainless steel, phosphor bronze, or the like, or alloys thereof, resins having nitrile group such as acrylonitrile, butadiene, styrene, or the like, resins having amide group such as polyamide or the like, resins having carboxyl group such as polycarbonate or the like, resins having aldehyde group such as polyacetals or the like, resins having sulfo group such as polysulfon or the like, other resins such as liquid crystal polymer or the like or compounds thereof, metals having high ink-resistance such as gold, tungsten, tantalum, nickel, stainless steel, titanium, or the like or compounds thereof, and with respect to the ink-resistance, materials coated thereon with metals above mentioned, resins having amide group such as polyamide or the like, resins having aldehyde group such as polyacetals or the like, resins with ketone group such as polyether etherketone or the like, resins having imide group such as polyimide or the like, resins having hydroxyl group such as phenol resin or the like, resins having ethyl group such as polyethylene or the like, resins having alkyl group such as polypropylene or the like, resins having epoxy group such as epoxy resin or the like, resins having amino group such as melamine resin or the like, resins having methylol group such as xylene resin or the like or compounds thereof, and seramics such as silicon dioxide or the like or compounds thereof.

Desirable materials for the separation wall are resins which have good heat resistance, good solvent resistance, and good properties for molding, represented by latest engineering plastics such as polyethylene, polypropylene, polyamide, polyethylene terephthalate, melamine resins, phenol resins, epoxy resins, polybutadiene, polyurethane, polyether etherketone, polyethersulfon, polyallylate, polyimide, polysulfon, liquid crystal polymer (LCP), or the like, or compounds thereof, or silicon dioxide, silicon nitride, metals such as nickel, gold, stainless steel, or the like, or alloys or compounds thereof, or any material coated the surface thereof with titanium or gold.

The thickness of the separation wall 30 may be determined in consideration of the properties and the shapes of the material from view points that the strength as the separation wall 30 can be achieved and the movable member 31 is assured of good operation, but preferably the thickness is around 0.5 μm to 10 μm.

Meantime, the thickness of the slit 35 for forming the movable member 31 is made 2 μm in the present embodiment, but the bubbling liquid and the discharging liquid are different liquid, if both liquid is to be prevented from being mixed, the slit width may be a gap in a size such that meniscus can be formed between both liquid to inhibit flow of respective liquid for preventing mixing up. For example, when liquid of around 2 cp (centi-pores) is used as the bubbling liquid, and a liquid of more than 100 cp used as the discharging liquid, liquid mixing can be prevented by slit of only around 5 μm, but preferable the slit may be 3 μm or less.

For the movable member 31 according to the present invention, thickness in the order of μm (t μm) is in the consideration, and the movable member of the thickness of cm order is out of consideration. For the movable member of the thickness in μm order, when the slit is to be made in the order of μm (W μm), preferably dispersion in manufacturing is to be considered to a degree.

When the thickness of the member opposing to the free end and/or side end of the movable member 31 forming the slit is equivalent to the thickness of the movable member, the relationship between the slit width and the thickness may be regulated in a range to be described hereafter paying attention to the dispersion in manufacturing so that the liquid mixing between the bubbling liquid and the discharging liquid can be inhibited. This is made possible by a structure, although under a limited condition, in such a way that, as a view point in designing, when high viscosity ink (5 cp, 10 cp or the like) is used against bubbling liquid of viscosity 3 cp or lower, if operation can be arranged to satisfy the formula $W/t \leqq 1$, mixing of the two liquids can be inhibited for a long time. The slit in the order of such μm may realize more assuredly "practically closed state" according to the present invention.

As described above, when liquid function is separated to a bubbling liquid and a discharging liquid, the movable member works as a practical separator. When the movable member travels in association with the generation of bubbles, bubbling liquid is observed to mix into discharging liquid in minor quantity. Considering from a point that the density of the coloring material in the discharging liquid for forming an image is generally around from 3% to 5%, in the case of ink jet recording, even if the bubbling liquid is contained in the discharging liquid droplet within a range of 20% or less thereof, variation of the concentration of the discharging liquid droplet is limited. Accordingly, mixed liquid such as the mixture of the bubbling liquid and the discharging liquid containing the bubbling liquid in a ratio 20% or less of the mixture is included in the scope of the present invention.

Meantime, in the embodiment of the above structure, even if the viscosity is changed, upper limit is mixture of 15% bubbling liquid, and with bubbling liquid of 5 cps or less, the upper limit of the mixture ratio is, although depending on driving frequency, around 10%. Specifically, if the viscosity of discharging liquid is reduced to 20 cps or lower, the mixture may be the more reduced (for example 5% or less).

Now, relationship in arrangement of the heat generating member and the movable member in the head will be described. By optimum arrangement of the heat generating member and the movable member, the pressure at the time of bubble generation by the heat generating member is made possible to be effectively used as the discharging pressure.

Figure 22:
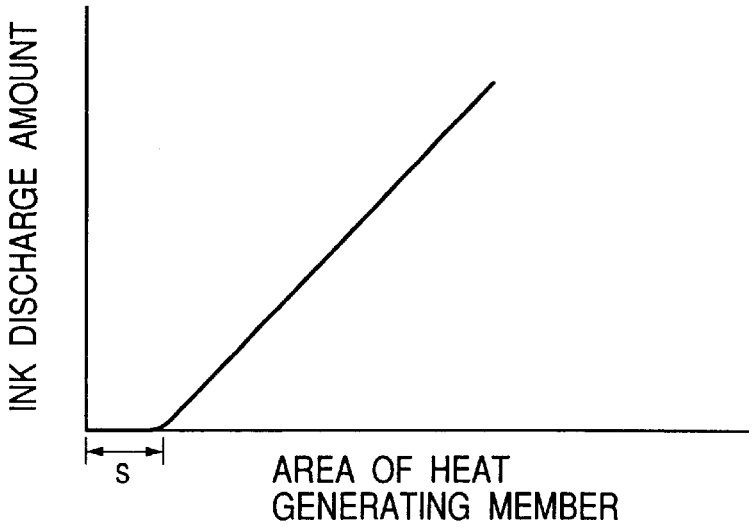
FIG. 22 is a graph showing relationship between area of heat generating member and ink discharge amount.

In ink jet recording method, or in the conventional technique so-called bubble jet recording method, where energy from heat or the like to ink is first given to ink, the ink then suffers a state change associated with abrupt volume change (generation of bubbles) and is discharged from a discharging port by action force based on the state change, and the ink is adhered to a recording medium to form an image. The area of the heat generating member is proportional to the discharged quantity of ink, as illustrated in FIG. 22, where ineffective region S for bubble generating is also illustrated. From the appearance of the burnt deposit on the heat generating member, the ineffective region S for bubble generating is known to be existing in the periphery of the heat generating member. From such observation, the periphery within 4 $\mu$m wide of the heat generating member is considered to be not related with the bubble generation.

Accordingly, in order to effectively use the bubble generating pressure, it may be said that arrangement of the movable member can be effectively made if the movable member is arranged such that the operation region of the movable member can cover the right above the effective region of bubble generation which is around 4 $\mu$m or more inside the periphery of the heat generating member. In the present embodiment, effective region of the bubble generation is restricted to be 4 $\mu$m or more inside the periphery of the heat generating member, the region is not restricted thereto depending on kind and generating method of the heat generating member.

Element Substrate

Figure 23A:
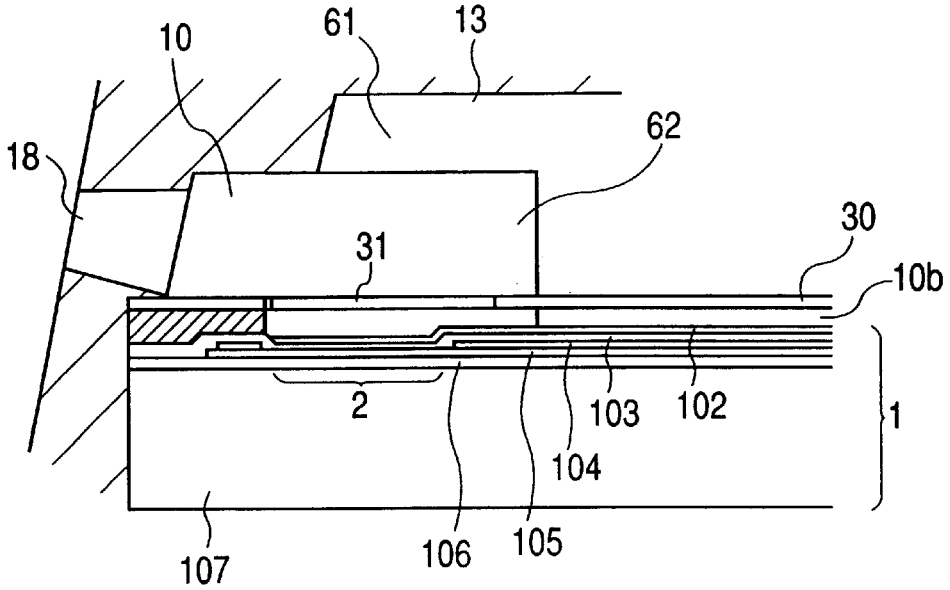
FIGS. 23A and 23B show schematic side sectional views of a liquid discharging head of the present invention.
Figure 23B:
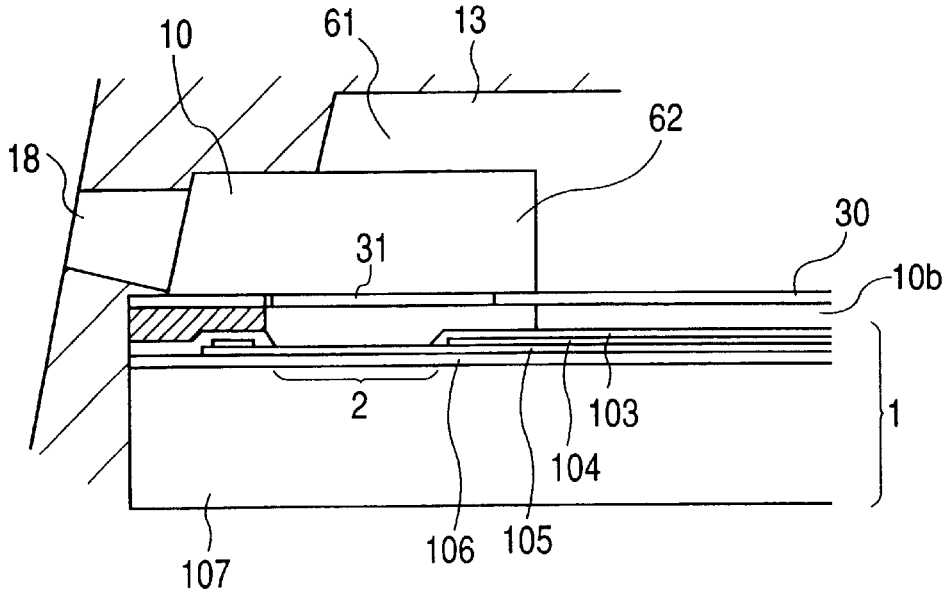

Structure of an element substrate on which a heat generating member for giving heat to liquid is provided will be described hereunder. FIGS. 23A and 23B are longitudinal sectional views of a liquid discharging head according to the present invention, and FIG. 23A illustrates the head with protective film to be described later, and FIG. 23B illustrates the head without the protective film.

On the element substrate 1, a second liquid flow path 16, a separation wall 30, a first liquid flow path 14, and a grooved member 50 provided with a groove composing a first liquid flow path are arranged.

On the element substrate 1, a silicon dioxide film or a silicon nitride film 106 is formed on a base member 107 of silicon and the like for insulation and heat storage, and over the film, an electric resistor layer 105 (0.01 to 0.2 $\mu$m thick) of hafnium borate ($HfB_2$), tantalum nitride (TaN), tantalum aluminum (TaAl) or the like and a wiring electrode 104 (0.2 to 1.0 $\mu$m thick) of aluminum and the like are applied by patterning. Voltage is applied from the wiring electrodes 104 to the resistor layer 105, and current is fed to the resistor layer to generate heat. Over the resistor layer between the wiring electrode, a protective film 103 of silicon dioxide, silicon nitride, or the like is formed in the thickness of 0.1 to 2.0 $\mu$m, and over the protective film, a cavitation resisting film layer 102 (0.1 to 0.6 $\mu$m thick) of tantalum or the like is formed to protect the resistor layer 105 from a variety of liquids such as ink or the like.

Specifically, as pressure or shock wave generated at bubble generation and bubble disappearance is extremely strong to deteriorate durability of hard and fragile oxidation film, cavitation resisting layer 102 is formed with metal material such as tantalum or the like.

Further, above described resistor 105 may be a structure in which the protective layer 103 is not required, depending on the combination of liquid, liquid flow path structure, and resistor material, and an example thereof is illustrated in FIG. 23B. As the material for the resistor layer 105 which does not require the protective layer 103, iridium-tantalum-aluminum alloy or the like may be named. In this way, the heat generating member in each of the previously mentioned embodiment may be of the structure with only the resistor layer (heat generating section) between the electrode, or the structure including the protective layer for protecting the resistor layer.

The present embodiment uses a heat generating member having a heat generating section composed of a resistor layer which generate heat in correspondence with electric signal, but the type of heat generating member is not restricted thereto, and any type of the heat generating member suits for the object of the present invention as long as the heat generating member can cause bubbling liquid to generate bubbles enough to discharge the discharging liquid. For example, a heat generating member may have, as a heat generating section, a light-heat converter which may generate heat by receiving light of laser or the like, or a heat generating section which may generate heat by receiving high-frequency waves.

Further, on the element substrate 1 described above, in addition to the electric heat converter composed of the resistor layer 105 composing the above described heat generating section and the wiring electrodes 104 for feeding electric signal to the resistor layer, functional elements such as transistor, diode, latch, shift register, and the like for selectively driving the electric heat converting element may be incorporated as an integrated body by semiconductor manufacturing process.

Figure 24:
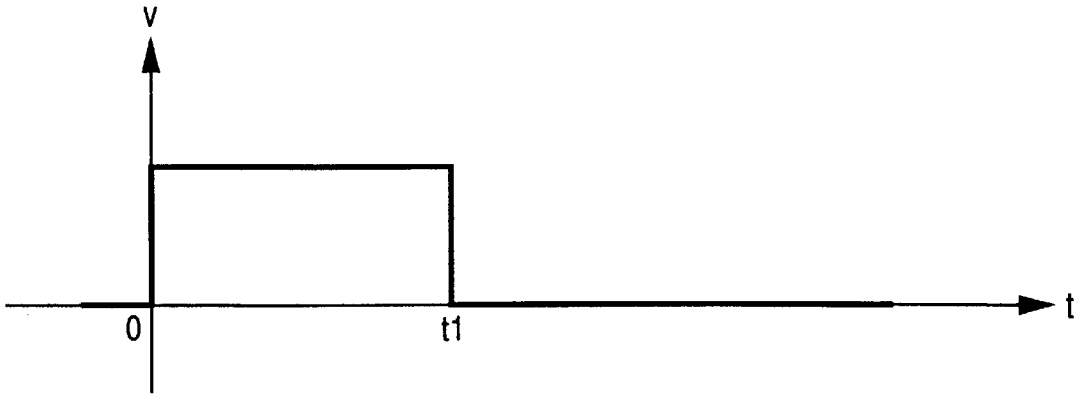
FIG. 24 is a graph showing an example of a driving pulse.

Further, in order to drive the heat generating section of the electric heat converter provided on the element substrate 1 as previously described, and to discharge liquid, a rectangular pulse as illustrated in FIG. 24 is applied to the resistor layer 105 via the wiring electrodes 104, and the resistor layer 105 between the wiring electrodes abruptly generates heat. In the head of each of the previously described embodiment, voltage 24 V, pulse amplitude 7 $\mu$sec, current 150 mA, and electrical signal 6 kHz are respectively applied to the heat generating member to drive the same, and by the operation previously described, ink being a liquid is discharged from the discharging port. However, condition for driving signal is not restricted to such described, and any driving signal which can cause the bubbling liquid to properly generate bubbles may be used.

Discharging Liquid, bubble Generating Liquid

As described in the previous embodiment, in the present embodiment, by the structure having a movable member as previously described, liquid can be discharged in stronger discharging force and higher discharging efficiency, and moreover in high speed, than the conventional liquid discharging head. Among the present embodiments, in the case where the same liquid is used for the bubbling liquid and the discharging liquid, the liquid is not deteriorated by the heat applied from the heat generator, dumps on the heat generator are hardly to be generated by heating, reversible state change between vaporization and condensation is possible by heat, and a variety of liquid may be used as long as the liquid has no danger to deteriorate the liquid flow path, movable member, or separation wall. Among such liquids, as a liquid to be used in recording, ink of the composition used for the conventional bubble jet apparatus may be used.

As a discharging liquid, a variety of liquid may be used irrespective of bubbling properties and thermal characteristic. Further, liquid of inferior bubbling properties which has caused discharging difficulty with the conventional apparatus, liquid easy to change quality and deteriorate by heat, and even high viscosity liquid may be used. However, desirable quality is that, as the nature of the liquid, the liquid may not disturb discharging, bubble generation, operation of the movable member, or the like by reaction of the discharging liquid per se or with the bubbling liquid. As the discharging liquid for recording, high viscosity ink or the like may be used. As the other discharging liquid, liquid of pharmaceutical, perfume, or the like which is susceptible to heat may be used.

In the present invention, as the recording liquid that may be used further for the discharging liquid, ink of the following composition has been used for recording. As the discharging speed has been accelerated by improvement in discharging force, impinging precision of liquid droplet has been improved so that a very good quality recorded image has been obtained.

| Composition of Dyeing Ink (Viscosity 2 cP) | |
|---|---|
| (C-1. Food Black 2) dye | 3 weight % |
| Diethylene glycol | 10 weight % |
| Thiodiglycol | 5 weight % |
| Ethanol | 5 weight % |
| Water | 77 weight % |

Structure of Liquid Discharging Head

Figure 25:
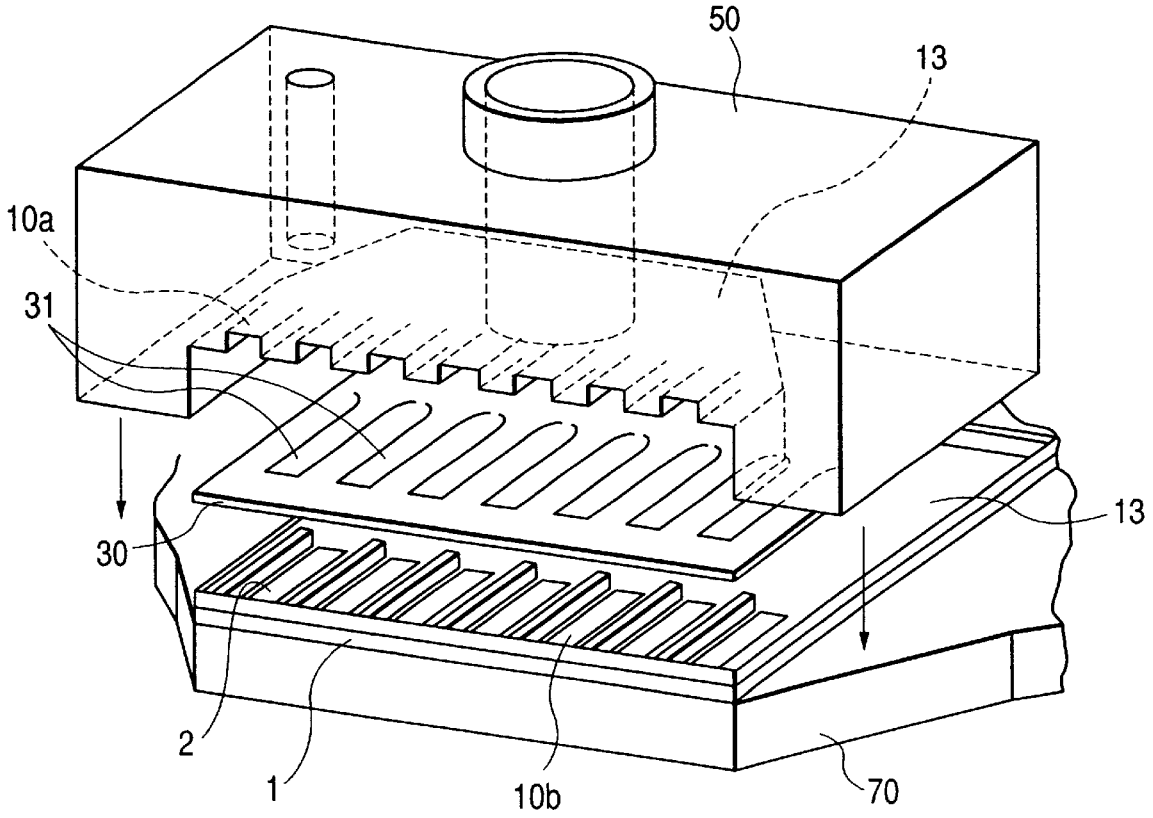
FIG. 25 is a schematic exploded perspective view of a liquid discharging head.

FIG. 25 is an exploded perspective view illustrating a whole structure of a liquid discharging head according to the present invention. On a supporter 70 of aluminum or the like, an element substrate 1 with the heat generating member 2 arranged thereon is provided. On the element substrate, a wall of the second flow path 10 and a wall of the common liquid chamber 13 are provided, and thereover, a separation wall 30 having the movable member 31 is provided. Further, on the separation wall 30, a plurality of grooves composing the first liquid flow path 10*a* and the roof 50 where a wall of the common liquid chamber 13 is disposed are provided.

Liquid Discharging Apparatus

Figure 26:
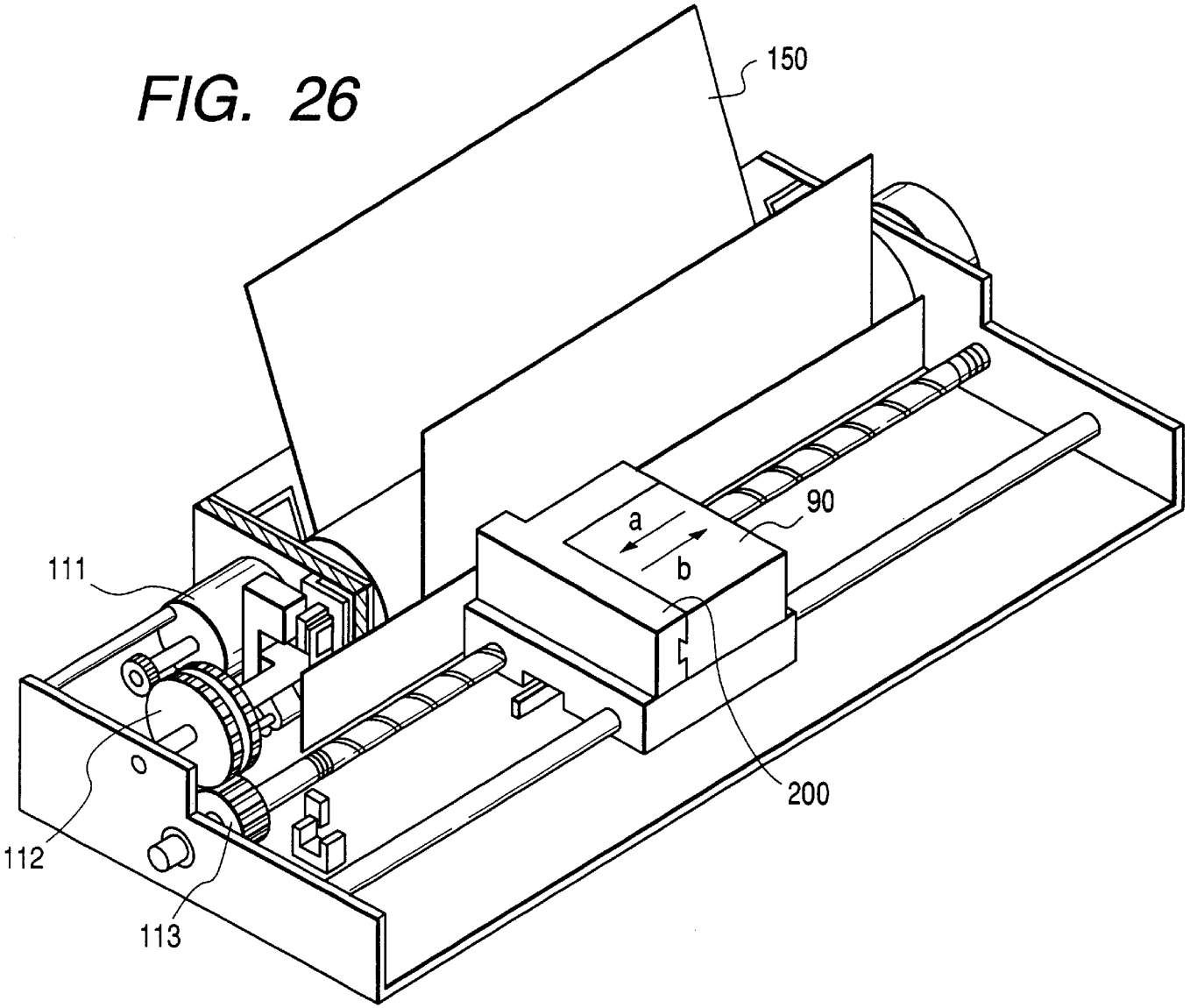
FIG. 26 is a schematic perspective view showing the major part of a liquid discharging apparatus.

FIG. 26 illustrates schematic structure of a liquid discharging apparatus having above described liquid jetting head mounted thereon. In the present embodiment, an ink discharging recording apparatus particularly using ink as a discharging liquid will be described. A carriage HC of the liquid discharging apparatus has a head cartridge where a liquid tank 90 for storing ink and a liquid discharging head 200 are removably mounted thereon, and reciprocally travels in the widthwise direction of a printing medium 150 of recording paper or the like conveyed by a printing medium conveying means. When a driving signal is fed to the liquid discharging means on the carriage from a driving signal feeding means which is not shown in Figures, recording liquid is discharged to the recording medium from the liquid discharging head corresponding to the signal.

Further, on a liquid discharging apparatus of the present embodiment, a motor 111 being driving source for driving the printing medium conveying means and the carriage, gears 112, 113, for conducting power from the driving source to the carriage, carriage shaft 115 and the like are provided. By the recording apparatus and a liquid discharging method performed by the recording apparatus, recorded materials in good quality image can be obtained by discharging liquid onto a variety of recording mediums.

Figure 27:
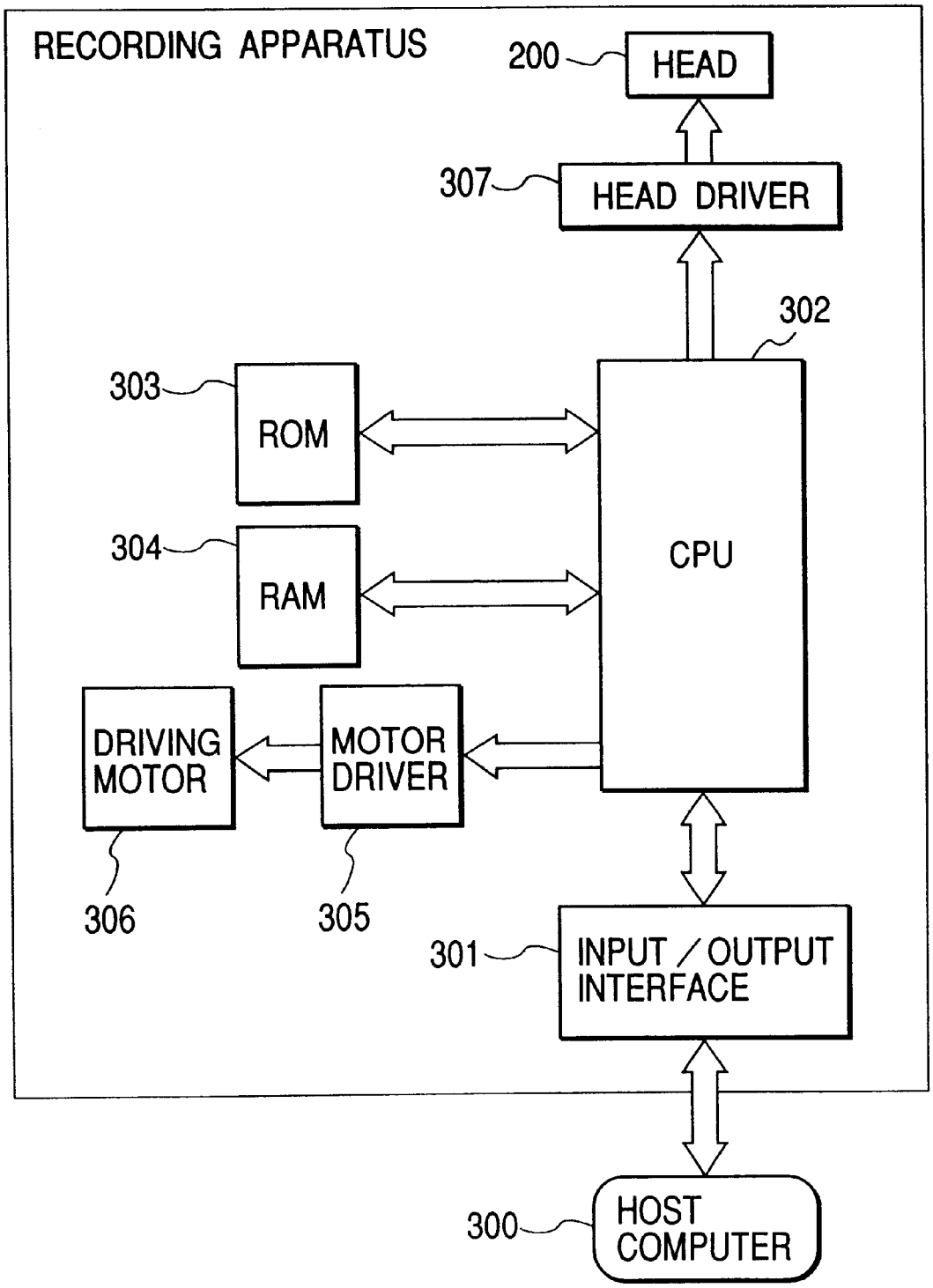
FIG. 27 is a block diagram of a liquid discharging apparatus.

FIG. 27 is a block diagram of the whole apparatus for operating ink discharging recording with the liquid discharging method and the liquid discharging head according to the present invention applied thereto.

The recording apparatus receives printing information from a host computer 300 as a control signal. The printing information is temporarily stored in an input interface 301 in the printing apparatus, simultaneously converted into data capable of being processed in the recording apparatus, and inputted into CPU 302 which also works as a head driving signal feeding means. The CPU 302 processes the data inputted into the CPU 302 using peripheral units such as RAM 304 and the like to convert into data (image data) to be printed.

Further, in order to record the image data on an adequate position of a recording paper, the CPU 302 produces driving data for driving the driving motor to travel, in synchronization with the image data, the recording paper and a recording head. The image data and the motor driving data are transferred to the head 200 and a driving motor 306 via a head driver 307 and a motor driver 305 respectively, and are respectively driven in controlled timing to form an image.

As a printing medium applicable to the recording apparatus as described above and to be given liquid such as ink or the like, a variety of papers or OHP sheets, plastic which is used for a compact disc or a decoration plate, woven fabric, metal such as aluminum, copper, or the like, leather such as cattle skin, pork skin, artificial leather, or the like, wood such as tree, plywood laminate, or the like, bamboo, ceramic such as a tile or the like, three dimensional structure material such as sponge or the like may be intended.

The recording apparatus described above also includes a printer apparatus for recording on a variety of papers, OHP sheets, or the like, a recording apparatus for plastics for recording on plastic such as a compact disc and the like, a recording apparatus for metals for recording on a metal plate, a recording apparatus for leather for recording on leather, a recording apparatus for wood for recording on wood, a recording apparatus for ceramic for recording on ceramics, a recording apparatus for recording on three dimensional netting structure member such as sponge and the like, a textile printing apparatus for recording on woven fabrics, and the like. Further, as discharging liquid to be used for such liquid discharging apparatuses, liquid suited for respective recording mediums and recording conditions may be used.

What is claimed is:

1. A liquid discharging head comprising:

a discharging port for discharging liquid;

a liquid flow path communicating with said discharging port;

a bubble generating region in said liquid flow path for causing liquid to generate a bubble to be utilized to discharge liquid from said discharging port;

a movable member having provided thereon a fulcrum and a movable portion disposed facing said bubble generating region, a free end of said movable portion being toward said discharging port and downstream of said fulcrum;

liquid flow path side walls extending along sides of said bubble generating region such that, at any given point along said liquid flow path in a horizontal direction, said liquid flow path walls extend to a vertical extent at least equal to the vertical range of movement of said free end of said movable portion when said movable portion moves from a non-displacement state to a maximum displacement state; and a common communicating space for commonly communicating said liquid flow path with a neighboring liquid flow path, a portion of said common communicating space being positioned downstream of said fulcrum, wherein said bubble generating region is on one side of said movable portion of said movable member and said common communicating space is on an opposite side of said movable portion of said movable member.

2. A liquid discharging head according to claim 1, wherein, when said movable member is in the maximum displacement state, said liquid flow path side walls extending along the sides of said bubble generating region extend from said movable portion of said movable member to a wall of said liquid flow path nearest said bubble generating region.

3. A liquid discharging head according to claim 1, wherein movable member is directly secured to a substrate on which a heat generating member for generating bubbles is provided, and a predetermined slit is formed relative to said substrate by said movable portion of said movable member by means of curvature provided on said movable member.

4. A liquid discharging head according to claim 1, wherein said free end of said movable member is positioned downstream in said liquid flow path relative to the center of said bubble generating region.

5. A liquid discharging head according to claim 1, wherein said common communicating space is positioned upstream in said liquid flow path relative to the position of said free end of said movable member when said movable member is in the non-displacement state.

6. A liquid discharging head according to claim 1, wherein said common communicating space is positioned upstream in said liquid flow path relative to the position of said free end of said movable member when said movable member is in the maximum displacement state.

7. A liquid discharging head according to claim 1, wherein a heat generating member for generating thermal energy to be used for generating bubbles by film boiling is provided in said bubble generating region.

8. A liquid discharging head according to claim 7, wherein a downstream end of said heat generating member is positioned downstream in said liquid flow path relative to said common communicating space.

9. A liquid discharging head according to claim 7, wherein an upstream end of said heat generating member is positioned upstream in said liquid flow path relative to the upstream end of said liquid flow path side walls.

10. A liquid discharging head according to claim 1, wherein said fulcrum of said movable member is positioned upstream in said liquid flow path relative to the upstream end of said liquid flow path side walls.

11. A liquid discharge head according to claim 1, wherein said common communicating space forms a region of low liquid resistance relative to a liquid flow directed toward said discharging port.

12. A liquid discharge head according to claim 1, wherein a substrate and a roof, which are joined together to form said liquid flow path, and said movable member are all formed with material of silicon group.

13. A liquid discharging port according to claim 12, wherein an orifice plate that forms said discharging port is formed with material of silicon group.

14. A liquid discharging apparatus comprising a liquid discharging head according to claim 1 and driving signal feeding means for feeding a driving signal to discharge liquid from said discharging head.

15. A liquid discharging appartus comprising a liquid discharging head according to claim 1 or claim 14 and printing medium conveying means for conveying a printing medium to receive liquid discharged from said liquid discharging head.

16. A liquid discharging apparatus according to claim 15, wherein ink is discharged from said liquid discharging head, and recording is performed by adherence of the ink on the printing medium.

17. A liquid discharging apparatus according to claim 15, wherein recording liquid in a plurality of colors is discharged from said liquid discharging head, and color recording is performed by adherence of the recording liquid in the plurality of colors on the printing medium.

18. A liquid discharging apparatus according to claim 15, further comprising a plurality of discharging ports, said discharging ports being arranged across a whole width of a recording region of the printing medium.

19. A liquid discharging method using a liquid discharging head including a discharging port for discharging liquid, a liquid flow path communicating with the discharging port, a bubble generating region in the liquid flow path for causing liquid to generate a bubble to be utilized to discharge liquid from the discharging port, a movable member having provided thereon a fulcrum and a movable portion disposed facing the bubble generating region, a free end of said movable portion being toward the discharging port and downstream of the fulcrum, liquid flow path side walls extending along sides of the bubble generating region such that, at any given point along the liquid flow path in a horizontal direction, the liquid flow path side walls extend to a vertical extent at least equal to the vertical range of movement of the free end of the movable portion when the movable portion moves from a non-displacement state to a maximum displacement state, and a common communicating space for commonly communicating the liquid flow path with a neighboring liquid flow path, a portion of the common communicating space being positioned downstream of the fulcrum, wherein the bubble generating region is on one side of the movable portion of the movable member and the common communicating space is on an opposite side of the movable portion of the movable member, said method comprising the steps of:

discharging liquid from the liquid flow path having the liquid flow path side walls, whereby growth of a bubble in the bubble generating region is directed toward the discharging port; and feeding liquid toward the discharging port, after the bubble starts to shrink, from the common communicating space.

20. A liquid discharging head comprising:

a discharging port for discharging liquid;

a liquid flow path communicating with said discharging port;

a bubble generating region in said liquid flow path for causing liquid to generate a bubble to be utilized to discharge liquid from said discharging port;

a movable member having provided thereon a fulcrum and a movable portion disposed facing said bubble generating region, a free end of said movable portion being toward said discharging port and downstream of said fulcrum;

liquid flow path side walls extending along sides of said bubble generating region and extending to an extent at least equal to a range of movement of said free end of said movable portion between a non-displacement state and a maximum displacement state; and a common communicating space for commonly communicating said liquid flow path with a neighboring liquid flow path, a portion of said common communicating space being positioned downstream of said fulcrum, wherein said bubble generating region is on one side of said movable portion of said movable member and said common communicating space is on an opposite side of said movable portion of said movable member.

21. A liquid discharging method using a liquid discharging head including a discharging port for discharging liquid, a liquid flow path communicating with the discharging port, a bubble generating region in the liquid flow path for causing liquid to generate a bubble to be utilized to discharge liquid from the discharging port, a movable member having provided thereon a fulcrum and a movable portion disposed facing the bubble generating region, a free end of said movable portion being toward the discharging port and downstream of the fulcrum, liquid flow path side walls extending along sides of the bubble generating region and extending to an extent at least equal to a range of movement of the free end of the movable portion between a non-displacement state and a maximum displacement state, and a common communicating space for commonly communicating the liquid flow path with a neighboring liquid flow path, a portion of the common communicating space being positioned downstream of the fulcrum, wherein the bubble generating region is on one side of the movable portion of the movable member and the common communicating space is on an opposite side of the movable portion of the movable member, said method comprising the steps of:

discharging liquid from the liquid flow path having the liquid flow path side walls, whereby growth of a bubble in the bubble generating region is directed toward the discharging port; and feeding liquid toward the discharging port, after the bubble starts to shrink, from the common communicating space.

* * * * *